United States Patent [19]

Yoshida et al.

[11] Patent Number: 5,008,773

[45] Date of Patent: Apr. 16, 1991

[54] SOLENOID VALVE CONTROL CIRCUIT

[75] Inventors: Takao Yoshida; Toshio Ikeda; Takhiro Douke; Toshio Eki, all of Kanagawa, Japan

[73] Assignee: Toto, Ltd., Fukuoka, Japan

[21] Appl. No.: 273,835

[22] Filed: Nov. 21, 1988

[30] Foreign Application Priority Data

Nov. 20, 1987 [JP] Japan ..... 62-294800
Nov. 20, 1987 [JP] Japan ..... 62-294801

[51] Int. Cl.[5] ..... H01H 47/32
[52] U.S. Cl. ..... 361/187; 361/160
[58] Field of Search ..... 361/144, 160, 186, 187

[56] References Cited

U.S. PATENT DOCUMENTS

| | | | |
|---|---|---|---|
| 3,628,102 | 12/1971 | Jauch | 361/187 |
| 3,648,145 | 3/1972 | Meyer et al. | 361/187 |
| 3,786,314 | 1/1974 | Mish | 361/187 |
| 4,214,290 | 7/1980 | Sloan | 361/187 |
| 4,618,908 | 10/1986 | Anttila | 361/187 |
| 4,742,583 | 5/1988 | Yoshida et al. | 4/313 |

*Primary Examiner*—A. D. Pellinen
*Assistant Examiner*—Jeffrey A. Gaffin
*Attorney, Agent, or Firm*—Lowe, Price, LeBlanc, Becker and Shur

[57] ABSTRACT

A solenoid valve control circuit for operatively connecting a battery to a solenoid to energize the solenoid to actuate a valve includes a coulomb controlling circuit for controllably supplying electric charge to the solenoid in accordance with predetermined criteria.

48 Claims, 11 Drawing Sheets

FIG. 17
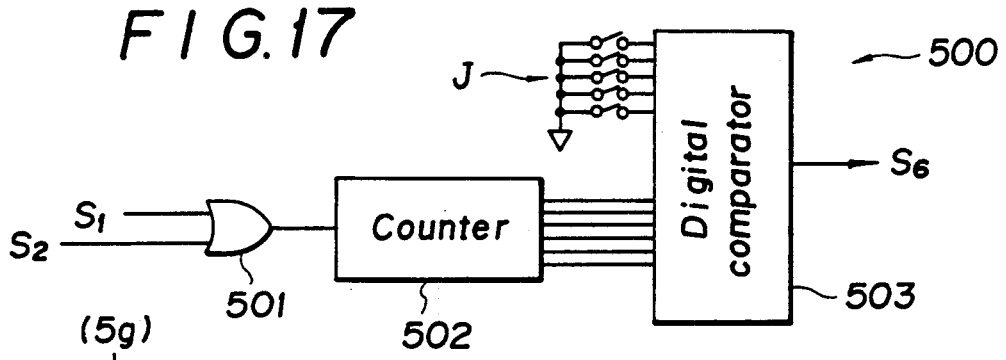
FIG. 18
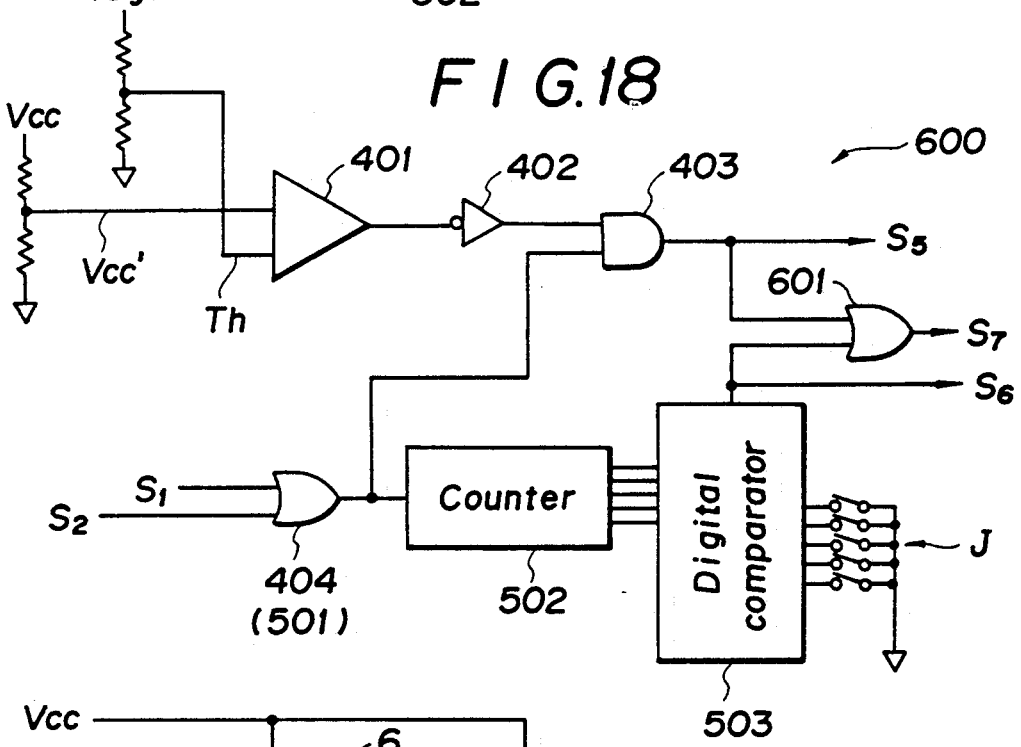
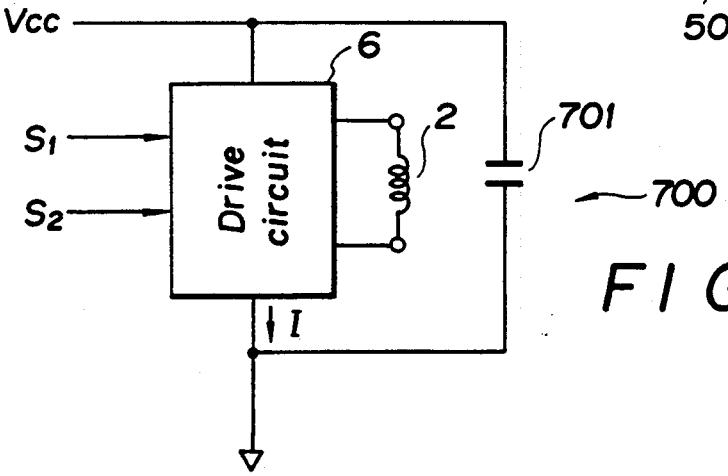
FIG. 19

SOLENOID VALVE CONTROL CIRCUIT

BACKGROUND OF THE INVENTION

1. Field of the Invention

The present invention relates to a circuit for controlling the operation of a solenoid valve, and more particularly to a solenoid valve control circuit which employs a battery as a power supply.

2. Description of the Relevant Art

Some washroom faucets have an automatic water supply control unit for automatically supplying water by actuating a faucet solenoid valve when the approach of a user to the faucet is detected, and for automatically stopping the water supply by actuating the solenoid valve again when the leaving of the user from the faucet is detected.

Generally, such solenoid valve comprises a plunger serving as a valve body and a latching solenoid for driving the plunger when it is energized. As shown in FIG. 4A of the accompanying drawings, it is empirically known that the solenoid valve has a certain characteristic relationship between a power supply voltage Vcc applied to the solenoid and the total coulombs, or charge Q (i.e., all the electric current flowing through the solenoid, "coulombs" or "charge" being hereinafter referred to as an "electric quantity") through the solenoid. When the power supply voltage Vcc is low, the electric quantity Qn which is required by the solenoid to drive the plunger is larger than the electric quantity Qn that is required by the solenoid to drive the plunger when the voltage Vcc is sufficiently high. Stated otherwise, the electric quantity Qn which is required and sufficient to drive the plunger has to be passed through the solenoid for a relatively long time when the power supply voltage Vcc is lower and for a relatively short time when the power supply voltage Vcc is higher.

Where a battery is employed as the power supply for the solenoid valve and the solenoid is to be energized for a constant period of time, a problem arises either when the voltage Vcc of the battery is higher because the battery is new or when the voltage Vcc of the battery is lower because the battery is old or deteriorated. More specifically, if the time for which the solenoid is to be energized is selected to be relatively short in view of new battery conditions, then the solenoid will not be sufficiently energized when the battery voltage Vcc becomes lower and the plunger will not be driven to a desired stroke. Conversely, if the time of energization of the solenoid is selected to be relatively long in view of old or deteriorated battery conditions, then the solenoid will be excessively energized when the battery voltage Vcc becomes higher, resulting in excessive electric power consumption and a shorter battery service life.

The present invention has been made in view of the aforesaid problems with conventional solenoid valve control circuits.

SUMMARY OF THE INVENTION

It is an object of the present invention to provide a solenoid valve control circuit which can energize a solenoid under optimum conditions irrespective of the voltage of a battery applied to the solenoid, so that the electric power from the battery will efficiently be consumed and the service life of the battery will be increased.

To accomplish the above object, there is provided in accordance with the present invention a solenoid valve control circuit for operatively connecting a battery to a solenoid to energize the solenoid to actuate a valve, the control circuit including coulomb controlling means for controllably supplying an electric quantity to the solenoid.

The above and further objects, details and advantages of the present invention will become apparent from the following detailed description of preferred embodiments thereof, when read in conjunction with the accompanying drawings.

BRIEF DESCRIPTION OF THE DRAWINGS

FIG. 17 is a block diagram of a portion of a solenoid valve control circuit according to a fourth modification;

FIG. 18 is a block diagram of a portion of a solenoid valve control circuit according to a fifth modification; and FIG. 19 is a block diagram of a portion of a solenoid valve control circuit according to a sixth modification.

DETAILED DESCRIPTION OF THE PREFERRED EMBODIMENTS

Figure 1:
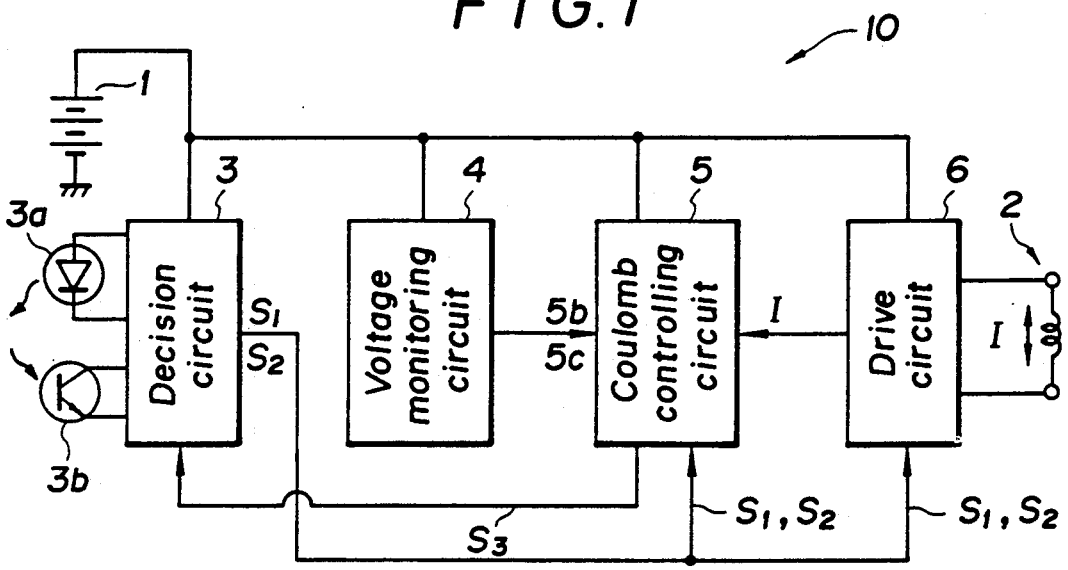
FIG. 1 is a block diagram of a solenoid valve control circuit according to a first embodiment of the present invention.

FIG. 1 shows a solenoid valve control circuit 10 according to a first embodiment of the present invention. The control circuit 10 in its entirety constitutes part of an automatic faucet unit (not shown). The control circuit 10 comprises a valve operation decision circuit 3 for determining valve operation, a voltage monitoring circuit 4 for monitoring a power supply voltage, a coulomb controlling circuit 5 for controlling the electric quantity to be supplied to a latching solenoid 2 of a solenoid valve (not shown), and a drive circuit 6 for driving the solenoid 2. The control circuit 10 controllably drives the latching solenoid 2 with electric power supplied from a battery 1 which is employed as the power supply for the control circuit 10. The solenoid 2 may have either a single winding (in which case the opening or closing of the solenoid valve is determined by the direction in which an electric current flows through the solenoid 2) or double windings (i.e., a winding for opening the solenoid valve and a winding for closing the solenoid valve). The power supply voltage Vcc is applied to the decision circuit 3 at all times. The decision circuit 3 is associated with an infrared-radiation light-emitting diode 3*a* which is intermittently energized to emit infrared radiation by the battery 1, and a phototransistor 3*b* which detects reflected light to detect whether a user moves toward or away from the automatic faucet device. Dependent on a detected signal from the phototransistor 3*b*, the decision circuit 3 applies valve opening/closing signals S1, S2 each of which can selectively take ON and OFF states (i.e., "high" and "low") to the drive circuit 6.

The automatic faucet unit with the control circuit 10 may be incorporated in various devices. Where the automatic faucet unit is assembled in a washroom faucet, both the signals S1, S2 are OFF when no user is present at the faucet. When an approaching user is detected, only the signal S1 is turned ON and the signal S2 remains OFF. As described later on, the signal S1 is turned OFF after the solenoid 2 has been energized with a suitable electric quantity. Thereafter, when the leaving of the user is detected, only the signal S2 is turned ON and the signal S1 remains OFF. After the solenoid 2 has been energized with a suitable electric quantity, the signal S2 is turned off. Therefore, the signal S1 is a solenoid valve opening signal, and the signal S2 is a solenoid valve closing signal. The light-emitting diode 3 and the phototransistor 3*b* are located at a suitable position near the faucet.

The power supply voltage monitoring circuit 4 monitors the voltage Vcc of the battery 1 and applies a signal dependent on the magnitude of the voltage Vcc to the coulomb controlling circuit 5.

Figure 4A:
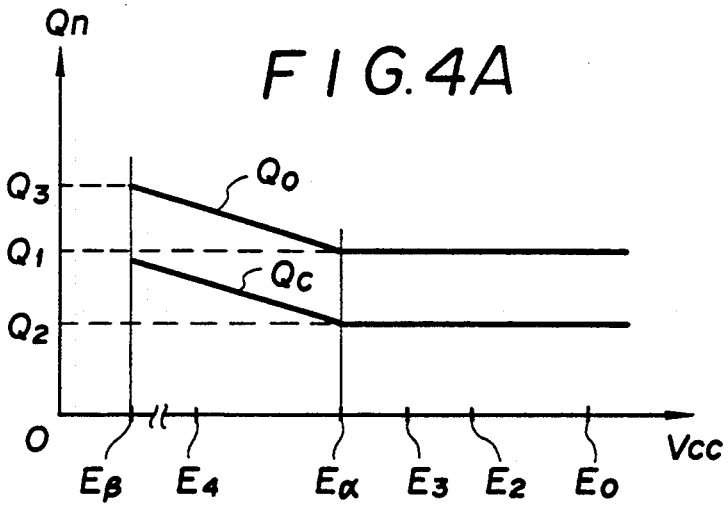
FIG. 4A is a graph showing the relationship between a power supply voltage and an electric quantity required by a solenoid.

When either one of the signals S1, S2 is turned ON, the solenoid valve drive circuit 6 supplies the solenoid 2 with an electric current I of a prescribed polarity to drive a plunger (not shown) serving as a valve body in a given direction. As shown in FIG. 4A, the electric quantity Qn=Qo which is required to open the valve is greater than the electric quantity Qn=Qc which is required to close the valve. In each of the opening and closing of the valve, the electric quantity required by the solenoid 2 to drive the plunger when the voltage Vcc of the battery 1 is low is greater than the electric quantity required by the solenoid 2 to drive the plunger when the battery voltage Vcc is sufficiently high. The horizontal axis of FIG. 4A represents the battery voltage Vcc, and the vertical axis the electric quantity Qn required by the solenoid 2 to drive the plunger. Reference characters $E\alpha$, $E\beta$, Q3 will be described later with reference to FIG. 4A, and reference characters E0 through E4 will be described later with reference to FIG. 10. Generally, the entire electric quantity Q (=total electric quantity) passing through the solenoid is expressed by:

$$Q=\int I dt$$

where I is the electric current flowing through the solenoid and t is the time for which the solenoid is energized.

The coulomb controlling circuit 5 applies a detected signal S3 of a "high" level to the decision circuit 3 when the electric quantity Q supplied to the solenoid 2 reaches a prescribed value (=Qn=Qo or Qc). The solenoid valve opening/closing signals S1, S2 are also supplied to the coulomb controlling circuit 5, which varies output conditions for the detected signal S3 based on the signals S1, S2.

In response to the detected signal S3 from the coulomb controlling circuit 5, the decision circuit 3 turns OFF one of the signals S1, S2 which is ON at the time, whereupon the drive circuit 6 de-energizes the solenoid 2.

Figure 2:
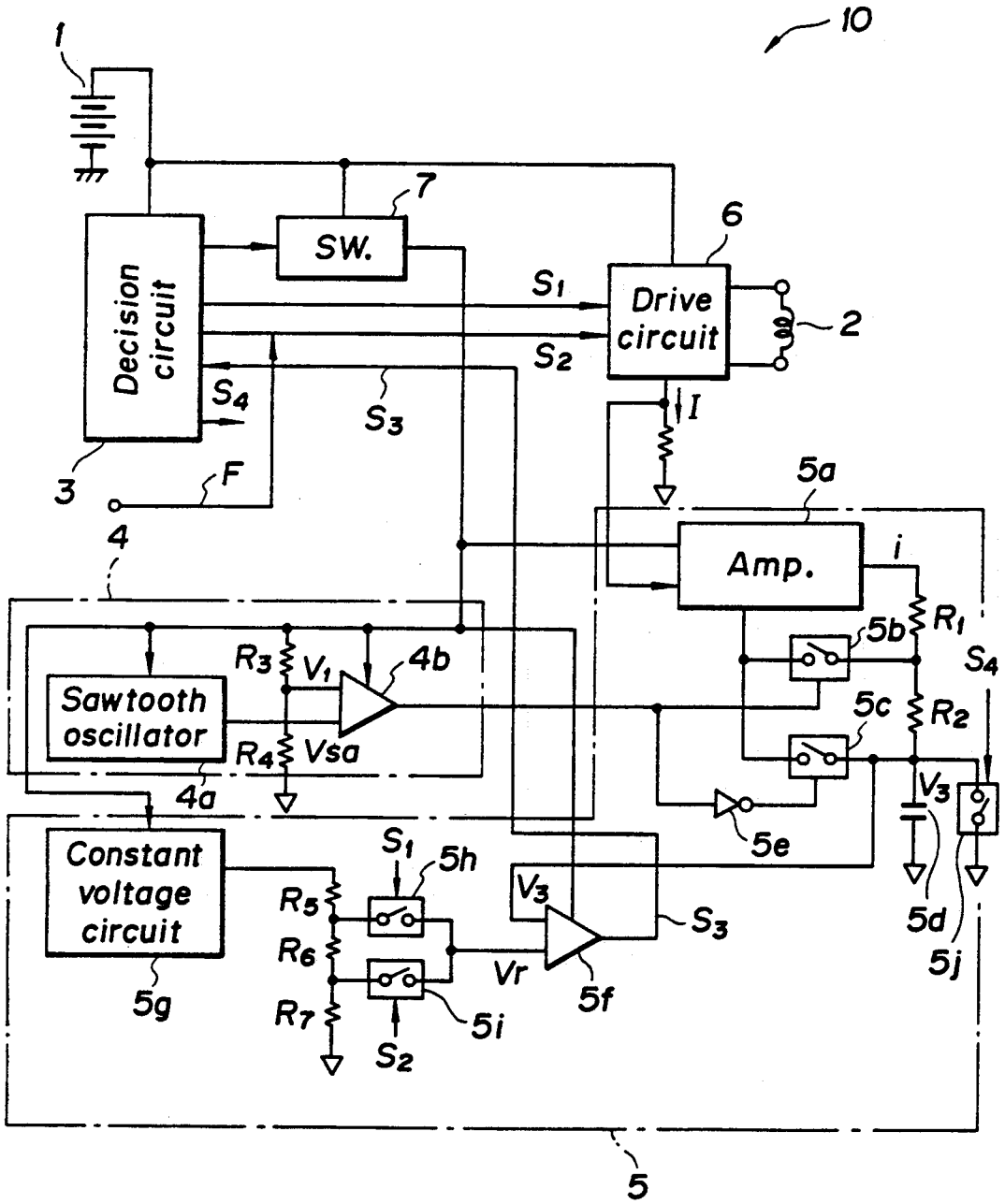
FIG. 2 is a circuit diagram, partly shown in block form, illustrating the solenoid valve control circuit in greater detail.

FIG. 2 shows the solenoid valve control circuit 10, particularly the voltage monitoring circuit 4 and the coulomb controlling circuit 5, in detail. The decision circuit 3 comprises a plurality of logic circuits, for example, and each time it detects the approach or leaving of a user, it turns on a power supply switch 7 to apply the power supply voltage Vcc to the voltage monitoring circuit 4 and the coulomb controlling circuit 5.

The drive circuit 6 is in the form of a bridge circuit comprising four power transistors, for example. The solenoid 2 is connected between the two output terminals of the bridge circuit. One of the two input terminals of the bridge circuit is connected to the positive terminal of the battery 1, whereas the other input terminal of the bridge circuit is grounded through a resistor. The signals S1, S2 are supplied to a pair of coacting power transistors which form opposite sides of the bridge circuit. While the solenoid 2 is being energized, part of the current I flowing through the solenoid 2 is supplied to a current amplifying circuit 5*a* of the coulomb controlling circuit 5 (Actually, a voltage signal similar to the solenoid current I is supplied to the amplifying circuit 5*a*).

The current supplied to the amplifying circuit 5*a* is supplied as a charging current i through resistors R1, R2 to a monitoring capacitor 5*d*.

Feedback signals are applied to the amplifying circuit 5*a* through switches 5*b*, 5*c* from those terminals of the resistors R1, R2 which are closer to the capacitor 5*d*. The switches 5*b*, 5*c* are exclusively closed by an output signal from the voltage monitoring signal 4. While only the switch 5*b* is being closed, the current gain of the amplifying circuit 5*a* is maintained at k1, and while only the switch 5*c* is being closed, the current gain of the amplifying circuit 5*a* is maintained at k2. k represents a prescribed gain determined by the circuit arrangement, and the current gains k1, k2 are selected such that $k1=k/R1$ and $k2=k/(R1+R2)$, and hence $k1>k2$. Therefore, as described later on, the average current gain of the amplifying circuit 5*a* is varied by the closing and opening of the switches 5*b*, 5*c* dependent on variations in the power supply voltage Vcc.

The charging current i which flows while only the switch 5*b* is being closed is indicated by:

$$i = k1 \cdot I = (k/R1) \cdot I = k \cdot I/R1.$$

The charging current i which flows while only the switch 5c is being closed is indicated by:

$$i = k2 \cdot I = (k/(R1+R2)) \cdot I = k \cdot I/(R1+R2).$$

When the power supply switch 7 is turned ON, a sawtooth oscillator 4a of the voltage monitoring circuit 4 starts operating to supply a sawtooth voltage Vsa as a reference voltage to a comparator 4b. The sawtooth oscillator 4a may be replaced with a triangle generator. When the power supply switch 7 is turned ON, the power supply voltage Vcc is divided by resistors R3, R4, and a divided voltage V1 is applied to the comparator 4b. The comparator 4b compares the applied voltage V1 with the reference voltage Vsa. While V1>Vsa, the comparator 4b issues an output signal of a "high" level, and while V1<Vsa, the comparator 4b issues an output signal of a "low" level. The output signal from the comparator 4b is applied directly to one of the switches 5b of the coulomb controlling circuit 5 and via an inverter 4e to the other switch 5c. The switches 5b, 5c are closed only when they are supplied with a high-level signal, and hence they are exclusively or alternatively closed. More specifically, while V1>Vsa, the switch 5b is closed and the amplifying circuit 5a has the current gain k1, and while V1<Vsa, the switch 5c is closed and the amplifying circuit 5a has the current gain k2 during which time the charging current i is lower. Denoted at F in FIG. 2 is an input line for closing the valve through a manual override.

As long as the current I flows through the solenoid 2, the capacitor 5d is continuously charged and a voltage V3 at the input terminal of the capacitor 5d progressively rises. The voltage V3 is applied as an input voltage to a comparator 5f which is supplied with a reference voltage Vr. While V3<Vr, the comparator 5f issues an output signal of a "low" level, and when V3=Vr, the comparator 5f issues an output signal of a "high" level. The high-level signal from the comparator 5f is sent as the de-energizing signal S3 to the decision circuit 3. The reference voltage V4 is determined according to the electric quantity Qn required by the solenoid 2, and thus has different values when the valve is to be opened (i.e., when the signal S1 is turned ON) and when the valve is to be closed (i.e., when the signal S2 is turned ON). The reference voltage Vr is selected to be equal to the voltage V3 across the capacitor 5d when the required electric quantity Qn (=Qo, Qc) flows through the solenoid 2 in the case where the power supply voltage Vcc is sufficiently high. The reference voltage Vr is produced by dividing, with resistors R5, R6, R7 and switches 5h, 5i, an output voltage from a constant voltage circuit or reference voltage generator 5g to which the power supply voltage Vcc is applied through the power supply switch 7. The switches 5h, 5i are closed respectively by the signals S1, S2.

As described above with reference to FIG. 4A, the electric quantity Qn (=Qo) required by the solenoid 2 to open the valve is greater than the electric quantity Qn (=Qc) required by the solenoid 2 to close the valve. Therefore, when opening the valve, the switch 5h is closed by the signal S1 to supply a relatively high divided voltage Vr as a reference voltage to the comparator 5f. When closing the valve, the switch 5i is closed by the signal S2 to supply a relatively low divided voltage Vr as a reference voltage to the comparator 5f.

Regardless of whether the valve is opened or closed, the voltage V3 across the capacitor 5d becomes equal to the reference voltage Vr when the electric quantity Q passing through the solenoid 2 reaches the required electric quantity Qn. At this time, the comparator 5f sends the high-level de-energizing signal S3 to the decision circuit 3.

At the same time the decision circuit 3 receives the signal S3, it turns OFF one of the signals S1, S2 which is ON at the time, opens the power supply switch 7, and applies an output signal S4 of a "high" level to a discharging switch 5j. The energization of the solenoid 2 is stopped, the circuits 4, 5 are de-energized, and the capacitor 5d is discharged, readying the control circuit 10 for a next cycle of operation.

As enclosed by the broken lines in FIG. 2, the voltage monitoring circuit 4 is constructed from the circuit elements 4a, 4b and the resistors R3, R4, and the coulomb controlling circuit 5 is constructed from the circuit elements 5a through 5j and the resistors R1, R2, R5, R6, R7.

Figure 3:
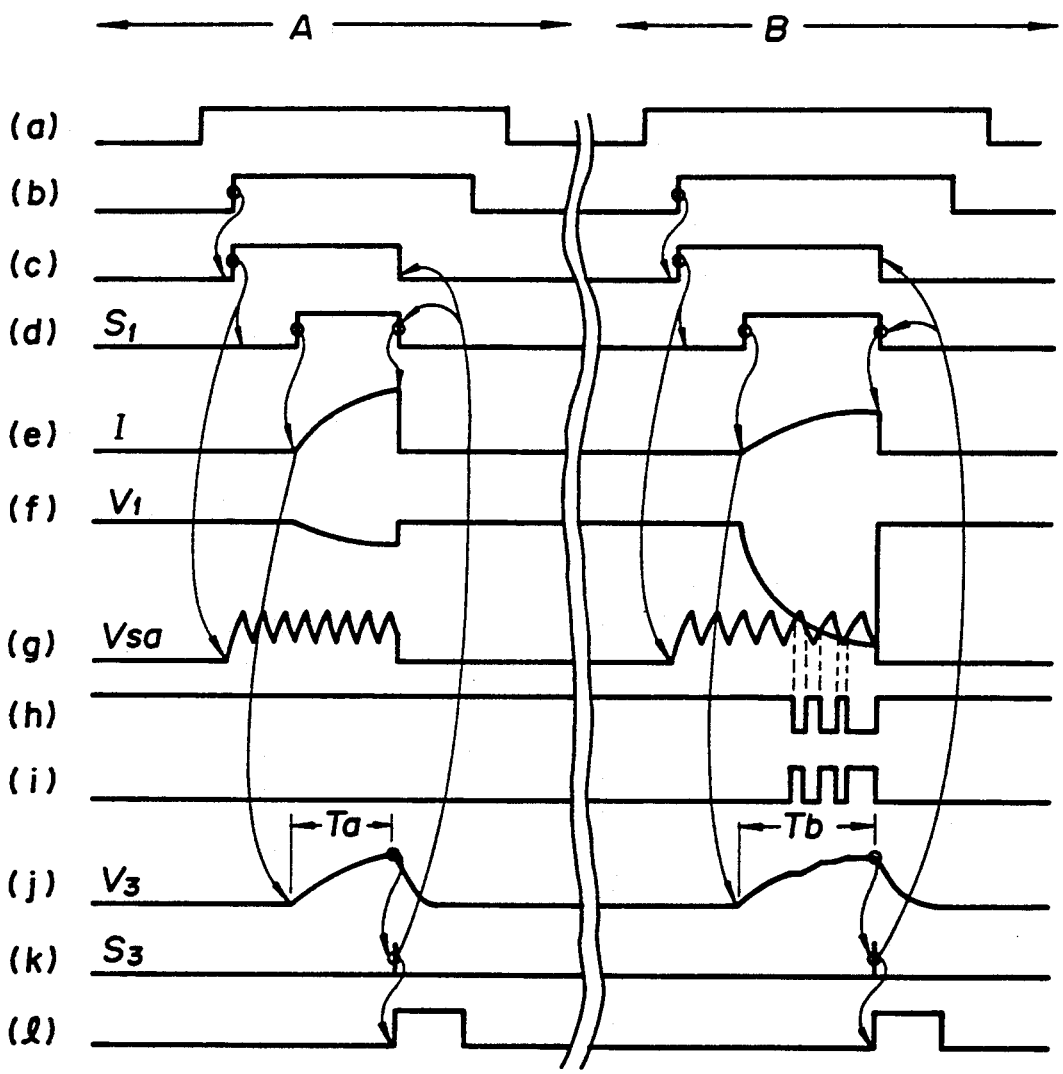
FIG. 3 is a timing chart of output signals or operating conditions of circuit elements in the circuit shown in FIG. 2.

FIG. 3 shows a timing chart of output signals or operating conditions of the circuit elements illustrated in FIG. 2. Those output signals shown in a lefthand area A in FIG. 3 are produced when the voltage Vcc of the battery 1 is sufficiently high, and those output signals shown in a righthand area B in FIG. 3 are generated when the battery voltage Vcc is lower. FIG. 3 only illustrates the output signals in the areas A, B for opening the valve. The output signals produced for closing the valve are similar and are not shown.

The charts of FIG. 3 represent the following conditions:

(a) The operating condition of the decision circuit 3, i.e., the manner in which the circuit 3 detects the approach of a user.

(b) The length of a processing time required to open the valve.

(c) The opening and closing condition of the power supply switch 7.

(d) The ON/OFF condition of the valve opening signal S1, i.e., the driving condition of the drive circuit 6. The drive circuit 6 is energized about 1 msec. after the power supply switch 7 is closed as shown at (c), and de-energized substantially at the same time that the power supply switch 7 is opened.

(e) The current I flowing through the solenoid 2.

(f) The battery voltage Vcc. In the area B, since the internal resistance of the battery 1 is high, the voltage Vcc drops considerably when the solenoid 2 is energized.

(g) The output voltage Vsa from the sawtooth generator 4a. The waveform and peak value of the voltage Vsa remain unchanged in the areas A, B.

(h) The output condition of the comparator 4b, which indirectly represents the opening and closing condition of the switch 5b.

(i) The opening and closing condition of the switch 5c, which is a reversal of the condition of (h).

With respect to the above charts (f), (g), (h), and (i), while the divided voltage V1 is higher than the sawtooth voltage Vsa, only the switch 5b is closed, and while the divided voltage V1 is lower than the voltage Vsa, only the switch 5c is closed.

(j) The voltage V3 for charging the capacitor 5d.

(k) The output condition of the comparator 5f, i.e., the output condition of the de-energizing signal S3.

(l) The time required for the decision circuit 3 to end the energization of the solenoid 2, i.e., the time in which the signal S4 is rendered "high" in level to close the discharging switch 5j for a time long enough to discharge the capacitor 5d.

In the area A, the switch 5b remains continuously closed since V1>Vsa at all times. Therefore, while the solenoid 2 is being energized, the charging current i=k-1·I flows into the capacitor 5d.

Figure 4B:
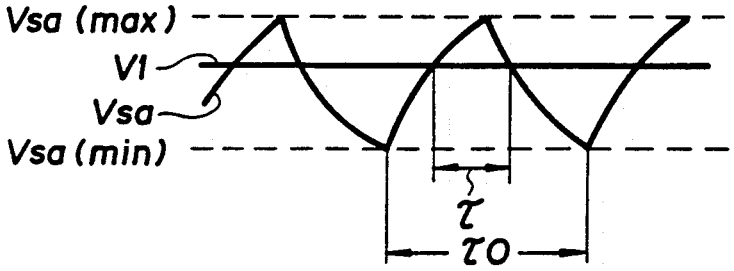
FIG. 4B is a graph showing the relationship between a voltage produced by dividing the power supply voltage and a sawtooth voltage.

In the area B, the switches 5b, 5c are exclusively closed based on the magnitude relationship between the sawtooth voltage Vsa and the divided voltage V1. As described above, the current gain of the amplifying circuit 5a is k1 when the switch 5b is closed and it is k2 when the switch 5c is closed. Therefore, the average gain k10 of the amplifying circuit 5a in the area B can be determined as follows:

FIG. 4B is a graph showing, at an enlarged scale, the charts (f) and (g) in overlapping relationship in the area B of FIG. 3. The reference characters Vsa(max) and Vsa(min) represent maximum and minimum values of the sawtooth voltage Vsa, and $\tau 0$ indicates the cyclic period of the sawtooth voltage Vsa. If the period in which V1<Vsa within one cycle of the voltage Vsa is $\tau(0 \leqq \tau \leqq \tau 0)$, then the average gain k10 of the amplifying circuit 5a can be expressed by:

$$k10=(1-(\tau/\tau 0))\cdot k1+(\tau/\tau 0)\cdot k2$$

Since $0 \leqq \tau \leqq \tau 0$ and k1>k2 as described above, $$k1 \geqq k10 \geqq 2.$$

Particularly, when V1≧Vsa(max), since $\tau=0$, $$k10=k1.$$

When V1≦Vsa(min), since $\tau=\tau 0$, $$k10=k2$$

Within the range of Vsa(min)≦V1≦Vsa(max), because the period $\tau$ is in inverse proportion to the divided voltage V1, the average gain k10 is proportional to the divided voltage V1. In the area B, therefore, the average gain k10 is proportional to the power supply voltage Vcc, and hence as the voltage Vcc is lowered, so is the average gain k10.

When the power supply voltage Vcc is relatively high, i.e., in the range of Vcc>Eα, in FIG. 4A, the electric quantity Qo required by the solenoid 2 to open the valve is of a substantially constant value Q1. When the power supply voltage Vcc is relatively low, i.e., Vcc=Eβ, the electric quantity Qo required by the solenoid to open the valve is of a value Q3. When the power supply voltage Vcc is in the range of Eβ≦Vcc≦Eα, Q1≦Qo≦Q3. The range Eβ≦Vcc≦Eα corresponds to the area B in FIG. 3.

The control circuit 10 is arranged such that when the power supply voltage Vcc is Eα and Eβ, the divided voltage V1 is equal to the maximum value Vsa(max) and the minimum value Vsa(min), respectively, of the sawtooth voltage Vsa. The values of the resistors R1, R2, the value of the reference voltage Vr supplied to the comparator 5f, and the capacitance of the capacitor 5d are selected such that when Vcc=Eα, the electric quantity Q supplied to the solenoid 2 is Q=Q1 and when Vcc=Eβ, Q=Q3. Therefore, Q=Q1 when Vcc>Eα. Since the average gain k10 is proportional to the power supply voltage Vcc when Eβ≦Vcc≦Eα, as described above, the electric quantity Q supplied to the solenoid 2 is controlled so as to be substantially equal to Qo in FIG. 4A.

The aforesaid description has been directed to the opening of the valve. For closing the valve, the electric quantity Q supplied to the solenoid 2 in the area B is controlled so as to be equal to Qc in FIG. 4A since only the reference voltage Vr supplied to the comparator 5f is lower.

As is apparent from the above description, the electric quantity Q supplied to the solenoid 2 is controlled so as to be dependent on the power supply voltage Vcc by the solenoid valve drive circuit 10. More specifically, the electric quantity Q is controlled so as to be equal to Qo, Qc shown in FIG. 4A. Therefore, the solenoid 2 is energized in an optimum fashion regardless of whether the battery voltage Vcc is high or low. As a consequence, the electric power from the battery 1 is efficiently consumed, and the service life of the battery 1 is prolonged.

Figure 5:
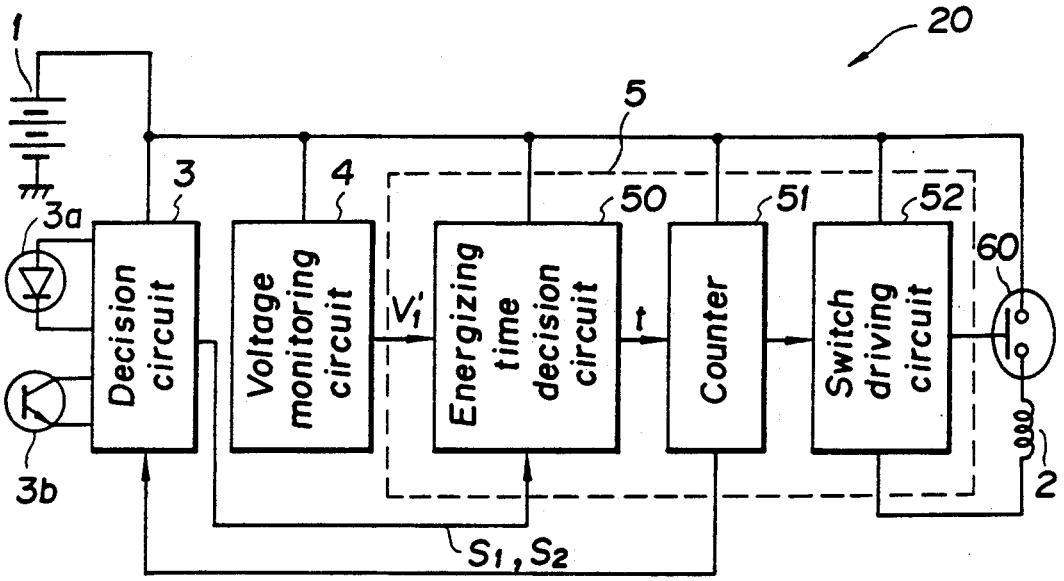
FIG. 5 is a block diagram of a solenoid valve control circuit according to a first modification.
Figure 6:
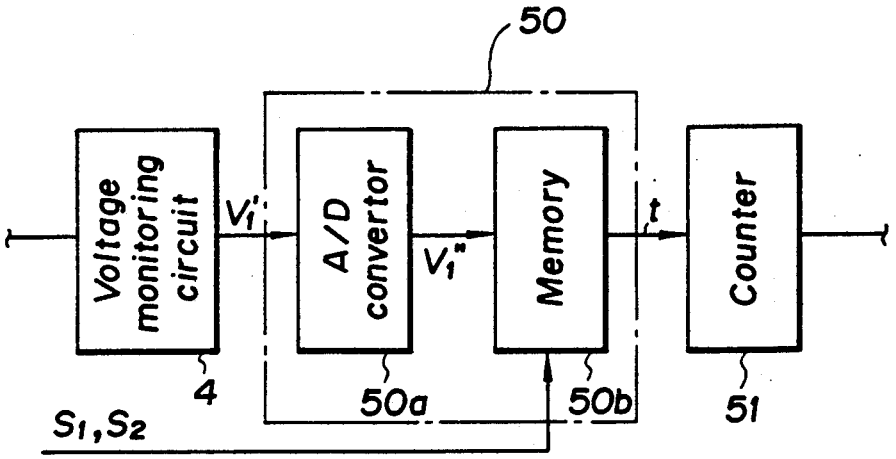
FIG. 6 is a block diagram showing some of the blocks of FIG. 5 in detail.

FIGS. 5 and 6 show a solenoid valve control circuit 20 according to a first modification of the present invention. Those components in FIGS. 5 and 6 which are identical to those of the control circuit 10 of the first embodiment are denoted by identical reference numerals, and will not be described.

The control circuit 20 has a coulomb controlling circuit 5 comprising an energizing time determining circuit 50, a counter 51, and a switch driving circuit 52. The energizing time determining circuit 50 receives an analog output V1' from the voltage monitoring circuit 4 and determines a time t for which the solenoid 2 is to be energized, based on the analog output V1' and the valve opening/closing signals S1, S2 from the decision circuit 3. The counter 51 counts the determined energizing time t. While the counter 51 is counting the energizing time t, the switch driving circuit 52 closes a switch 60 to energize the solenoid 2. The switch 60 comprises a directional element such as a bridge circuit or the like for energizing the solenoid 2. The analog output V1' from the voltage monitoring circuit 4 is produced by dividing the power supply voltage Vcc at a prescribed ratio.

As shown in FIG. 6, the energizing time determining circuit 50 comprises an A/D converter 50a for converting the analog output V1' from the voltage monitoring circuit 4 into a digital signal V1", and a memory 50b for determining an energizing time t in response to the digital signal V1" and the valve opening/closing signals S1, S2. The memory 50b has two memory maps which can be selected by the signals S1, S2, respectively. Each of the memory maps stores data on required energizing times t based on the characteristics of the required electric quantity Qn and the time-base current characteristics of the solenoid 2. The digital signal V1" is applied as an address signal to the memory 50b to read data on the required energizing time t from the memory map which has been selected by the signal S1 or S2.

The electric quantity Q supplied to the solenoid valve 2 can be controlled so as to be of a magnitude dependent on the power supply voltage Vcc by the solenoid valve control circuit 20. Accordingly, the solenoid 2 is energized in an optimum fashion regardless of whether the battery voltage Vcc is high or low. As a consequence, the electric power from the battery 1 is efficiently consumed, and the service life of the battery 1 is prolonged.

The circuit components 50, 51 of the control circuit 20 may be replaced with a PWM (Pulse Width Modulation) circuit responsive to the output from the power supply voltage monitoring circuit for producing pulses of a duration inversely proportional to the power supply voltage Vcc, and an output signal from the PWM circuit may be supplied to the switch driving circuit 52. In this case, the PWM circuit doubles as a timer circuit. Thus, a pulse generator with the pulse duration variable by the output from the power supply voltage monitoring circuit may be used as a timer.

Figure 7:
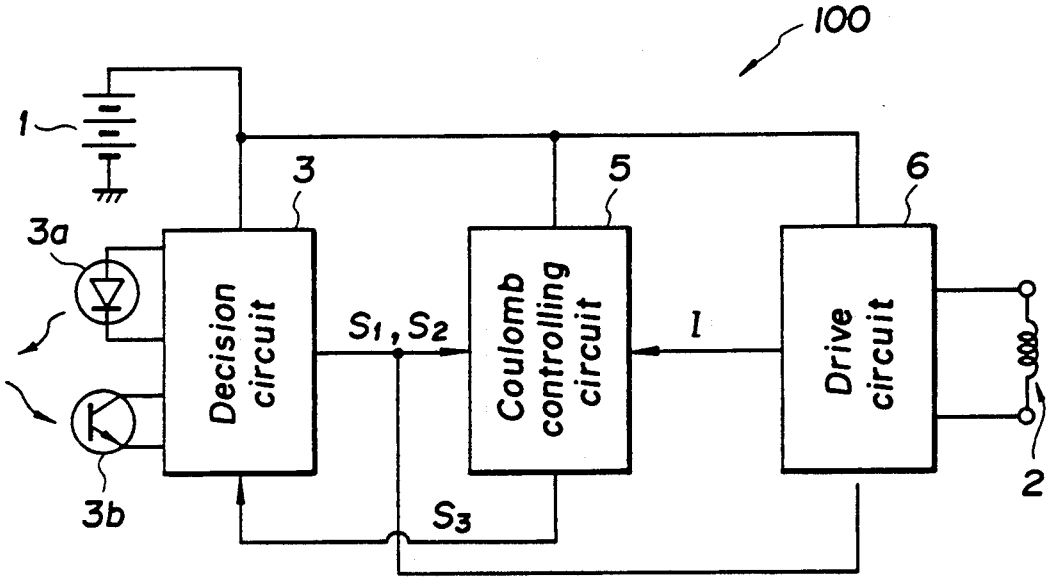
FIG. 7 is a block diagram of a solenoid valve control circuit according to a second embodiment of the present invention.
Figure 8:
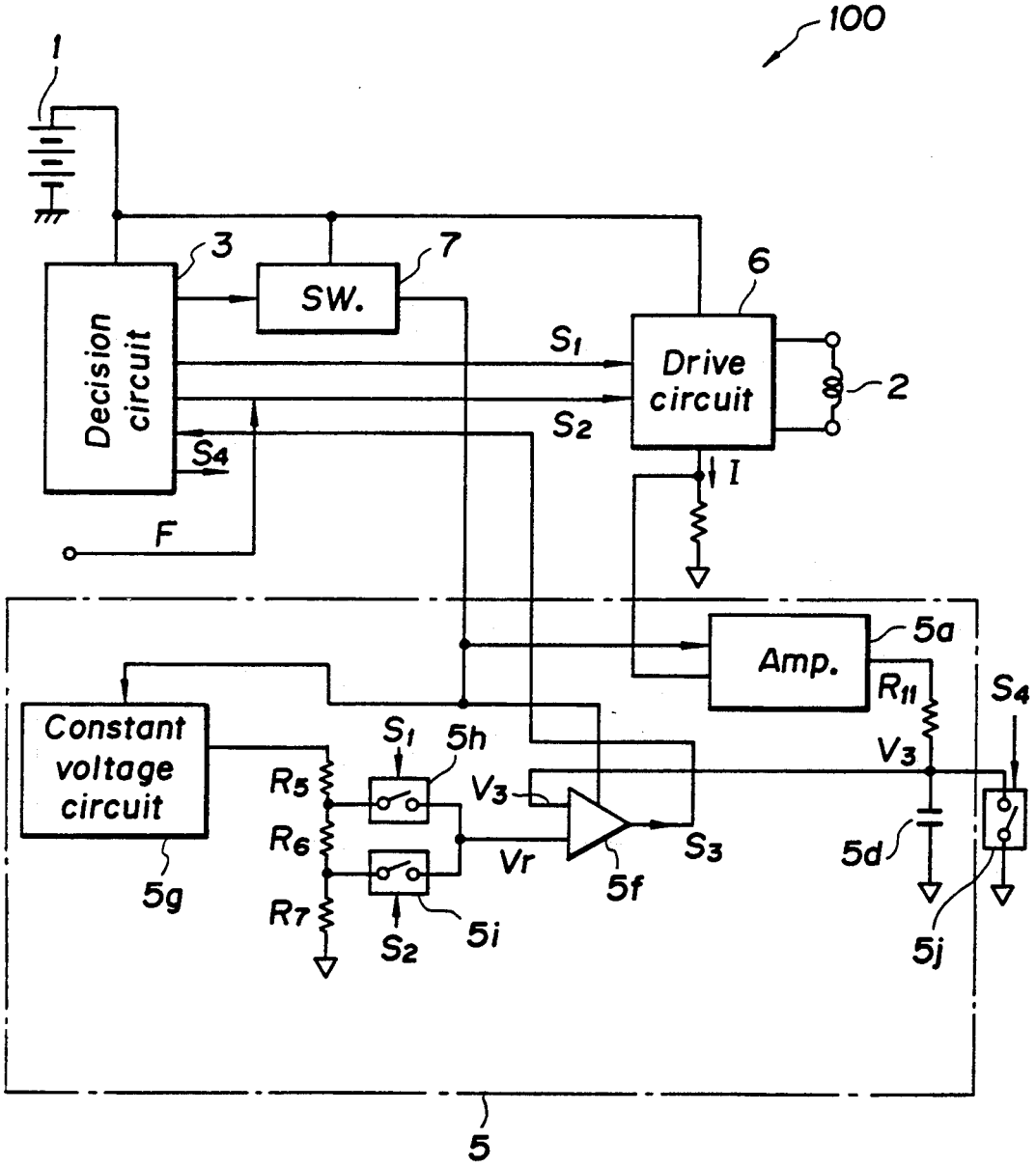
FIG. 8 is a circuit diagram, partly shown in block form, illustrating the solenoid valve control circuit in greater detail.

A solenoid valve control circuit 100 according to a second embodiment of the present invention will be described below with reference to FIGS. 7 through 9. Those parts in FIGS. 7 through 9 which are identical to those of the control circuit 10 of the first embodiment are designated by identical reference numerals, and will not be described in detail.

The control circuit 100 differs from the control circuit 10 of the first embodiment in that it lacks the power supply voltage monitoring circuit 4, the switches **5*b*, 5*c*, and the resistors R1, R2 of the control circuit 10. Instead, the current gain of the current amplifying circuit 5*a* is set to a value k3. While the solenoid 2 is being energized, a charging current i (=k3·I) flowing through a resistor R11 is supplied to the capacitor 5*d*** at all times.

Figure 9:
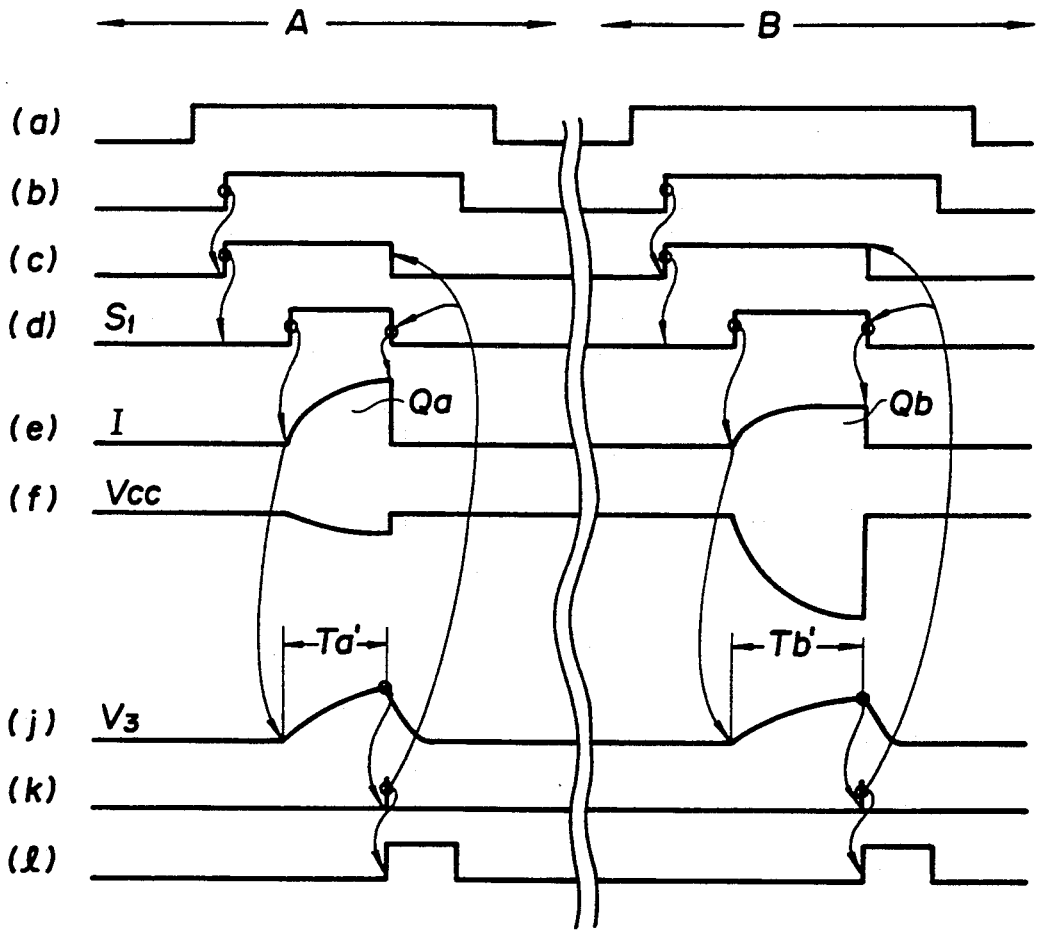
FIG. 9 is a timing chart of output signals or operating conditions of circuit elements in the circuit shown in FIG. 8.

FIG. 9 is a timing chart showing output signals or operating conditions of the circuit elements in the control circuit 100. The charts (a) through (f) and (j) through (l) in FIG. 9 indicate the same conditions as those in FIG. 3. It is assumed that the power supply voltage Vcc varies in a relatively high range in the area A, and in a relatively low range in the area B.

As shown in FIG. 9, the solenoid 2 is energized for a time Ta' in the area A, and for a time Tb' in the area B. The electric quantity Q supplied to the solenoid 2 is indicated by the areas of sector-shaped portions Qa, Qb in the chart (e) in the areas A, B.

It is now assumed that the valve is to be opened.

When the voltage V3 across the capacitor **5*d* is equal to the reference voltage Vr, the de-energizing signal S3 is issued. Assuming that the capacitor 5*d* has a capacitance C, the charge q stored in the capacitor 5*d*** is of a constant value qr which is given by:

$$qr\ (C \cdot V3) = C \cdot Vr \tag{1}$$

In the area A, the following equation is established:

$$qr = \int_0^{Ta'} idt \tag{2}$$

Since i=k3·I as described above, the equation (2) can be modified as follows:

$$qr = \int_0^{Ta'} k3 \cdot Idt = k3 \cdot \int_0^{Ta'} Idt \tag{3}$$

Inasmuch as $\int_0^{Ta'}$ Idt represents the electric quantity Q supplied to the solenoid 2 in the area A, the following is obtained from the equation (3):

$$qr = k3 \cdot Qa \tag{4}$$

The equation (4) can be modified into:

$$Qa = qr/k3 \tag{5}$$

Likewise, in the area B, $$qr = \int_0^{Tb'} idt \tag{6}$$

Since i=k3·I as described above, the equation (6) can be modified as follows:

$$qr = \int_0^{Tb'} k3 \cdot Idt = k3 \cdot \int_0^{Tb'} Idt \tag{7}$$

Inasmuch as $\int_0^{Tb'}$ Idt represents the electric quantity Q supplied to the solenoid 2 in the area B, the following is obtained from the equation (7):

$$qr = k3 \cdot Qb \tag{8}$$

The equation (8) can be modified into:

$$Qb = qr/k3 \tag{9}$$

In the control circuit 100, the reference voltage Vr supplied to the comparator **5*f* when the drive signal S1 is turned ON, is set to a prescribed value Vr=k3·Q10/C. The value Q10 may be the same as the value Q1 in FIG. 4A**.

Since $$qr = C \cdot Vr \tag{1}$$

as described above, $$qr = C \cdot (k3 \cdot Q10/C) = k3 \cdot Q10 \tag{10}$$

By putting the equation (10) into the equations (5) and (6), the following equations can be obtained:

$$Qb = Q10 \tag{11}$$

$$Qa = Q10 \tag{12}$$

From the equations (11), (12) results the following:

$$Qa = Qb = Q10 \tag{13}$$

The electric quantities Qa, Qb supplied to the solenoid 2 in the respective areas A, B are equal to each other, and to the value Q10. With Q10=Q1, the electric quantities Qa, Qb are equal to Q1.

According to the control circuit 100, therefore, the electric quantity Q supplied to the solenoid 2 is controlled at the constant value Q10 irrespective of variations in the power supply voltage Vcc.

This also holds true for closing the valve. When closing the valve, the reference voltage Vr is set to Vr=k3·Q20/C. Q20 may be set so as to be equal to Q2 in FIG. 4A.

With the control circuit 100, accordingly, the constant electric quantity is always supplied to the solenoid regardless of irregularities in the power supply voltage. As a result, the electric power of the battery is efficiently consumed and the battery has a prolonged service life.

Figure 10:
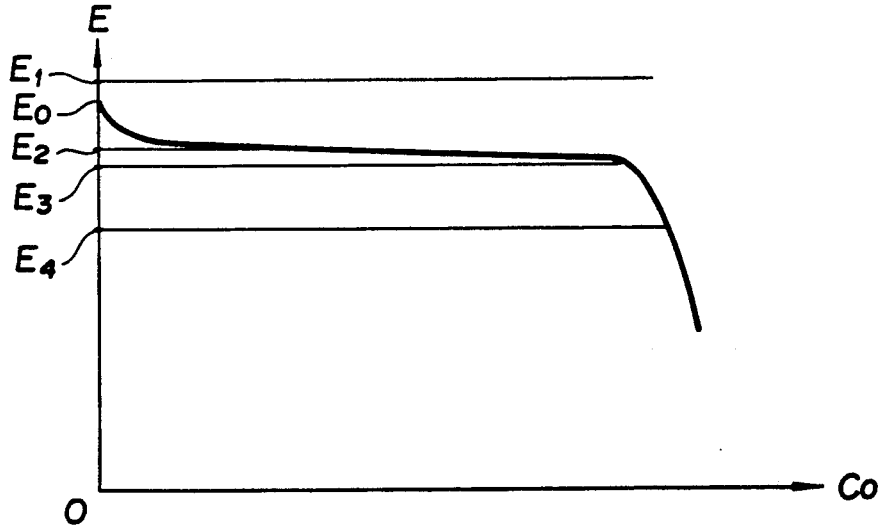
FIG. 10 is a graph showing voltage characteristics of a general battery.

FIG. 10 shows voltage characteristics of a general lithium battery. The horizontal axis of the graph of FIG. 10 represents the amount of electric power of the battery which is consumed with time, and the vertical axis represents the voltage E of the battery when there is a load connected to the battery. As shown, the voltage E of the lithium battery has an initial value E0 when not in use, and as the stored electric energy is consumed, the battery voltage is gradually lowered stably in the range of E2>E>E3. When the voltage E is further lowered to a lower limit E4 as a result of continued energy consumption, the battery can no longer be used as a power supply. The above characteristics are the same as those of other batteries such as an alkaline battery. The reference character E1 indicates an electromotive force in the battery.

Referring back to FIG. 4A, the above voltage range of E2>E>E3 is very narrow, and the electric quantity Qn (=Qo, Qc) required by the solenoid 2 has a substantially constant value (Q1, Q2) in this voltage range. It is assumed that the power supply voltage Vcc represents the battery voltage E (Vcc=E).

By controlling the electric quantity Q supplied to the solenoid 2 so as to be of a value (Q1, Q2) within the above range of E2>E>E3 in FIG. 4A, the solenoid 2 can be energized optimally in most of the period of time in which the battery is used.

By setting the value Q10 in the control circuit 100 to Q10=Q1, the electric quantity Q supplied to the solenoid 2 can be controlled so as to be the required electric quantity Qn (=Q1) even if the power supply voltage Vcc varies in the range (E2>E>E3).

The above operation remains the same when the valve is closed. By setting the value Q20 to Q20=Q2, the electric quantity Q supplied to the solenoid 2 can be controlled so as to be the required electric quantity Qn (=Q2) even if the power supply voltage Vcc varies in the range (E2>E>E3).

Where the values Q10, Q20 in the control circuit 100 are thus established, the solenoid 2 can be energized optimally in most of the period of time in which the battery is used. The electric energy stored in the battery 1 is thus efficiently consumed, and the service life of the battery 1 is prolonged.

Figure 11:
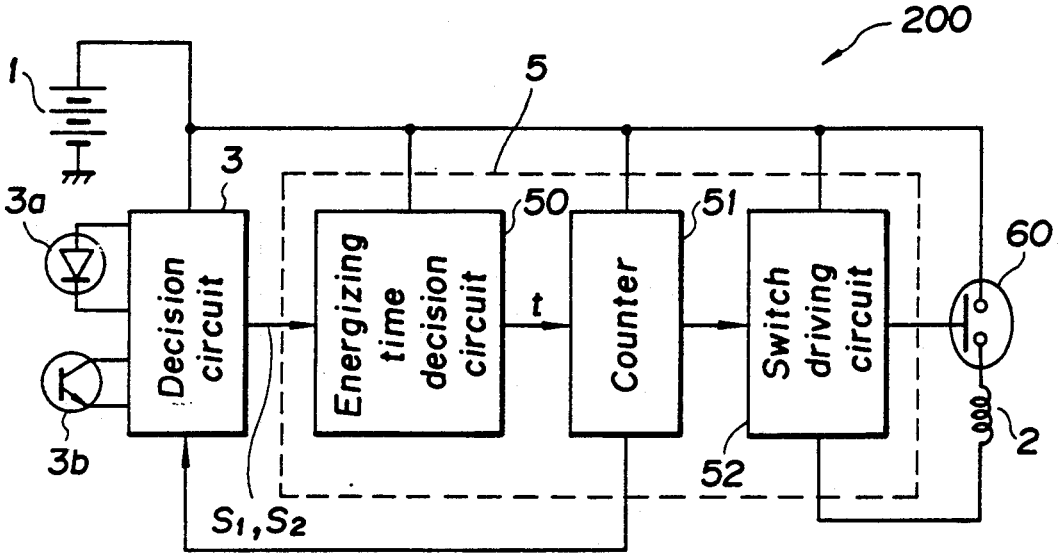
FIG. 11 is a block diagram of a solenoid valve control circuit according to a second modification.
Figure 12:
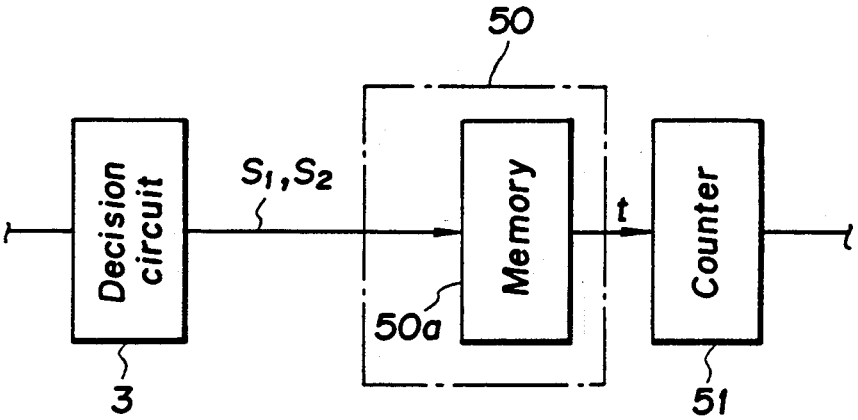
FIG. 12 is a block diagram showing some of the blocks of FIG. 11 in detail.

FIGS. 11 and 12 illustrate a solenoid valve control circuit 200 according to a second modification of the present invention. Those parts in FIGS. 11 and 12 which are identical to those of the control device 20 of the first modification are denoted by identical reference numerals, and will not be described in detail.

The control circuit 200 has a coulomb controlling circuit 5 comprising an energizing time determining circuit 50, a counter 51, and a switch driving circuit 52. The energizing time determining circuit 50 determines a time t for which the solenoid 2 is to be energized, based on the valve opening/closing signals S1, S2 from the decision circuit 3. The circuit elements 52, 60 are equivalent to the drive circuit 6 shown in FIG. 1.

As shown in FIG. 12, the energizing time determining circuit 50 comprises a memory 50*a* for determining an energizing time t in response to the valve opening/closing signals supplied thereto. The memory 50*a* stores two data which can be selected by the signals S1, S2, respectively. These data represent values of the time t required to supply a prescribed electric quantity, e.g., the required electric quantity Qn (=Q1, Q2) in the range of E2>E>E3 in FIG. 4A, to the solenoid. The time data selected from the memory 50*a* by the signal S1 or S2 is sent to the counter 51.

According to the solenoid valve control circuit 200, the electric quantity Q supplied to the solenoid valve 2 is controlled at a prescribed magnitude (Qn=Q1, Q2) dependent on the power supply voltage Vcc in most of the period of time in which the battery is used. As a consequence, the solenoid 2 is energized optimally in most of the period of time of use of the battery. The electric energy stored in the battery 1 is efficiently consumed and the service life of the battery 1 is thus prolonged through a simple and inexpensive circuit arrangement.

The control circuit 200 is advantageous over the control circuit 20 shown in FIGS. 5 and 6 in that it requires no power supply voltage monitoring circuit and no A/D converter, and that the size of the memory 50*a* used is small.

The memory 50*a* and the counter 51 may be replaced with a timer circuit which receives the valve opening/closing signals S1, S2 and issues an energizing time t for directly obtaining a prescribed electric quantity to be supplied to the solenoid.

For a simpler circuit arrangement, the pulse generating times produced in response to the valve opening/closing signals S1, S2 may be equal to each other to equalize the electric quantities for opening and closing the valve.

Figure 13:
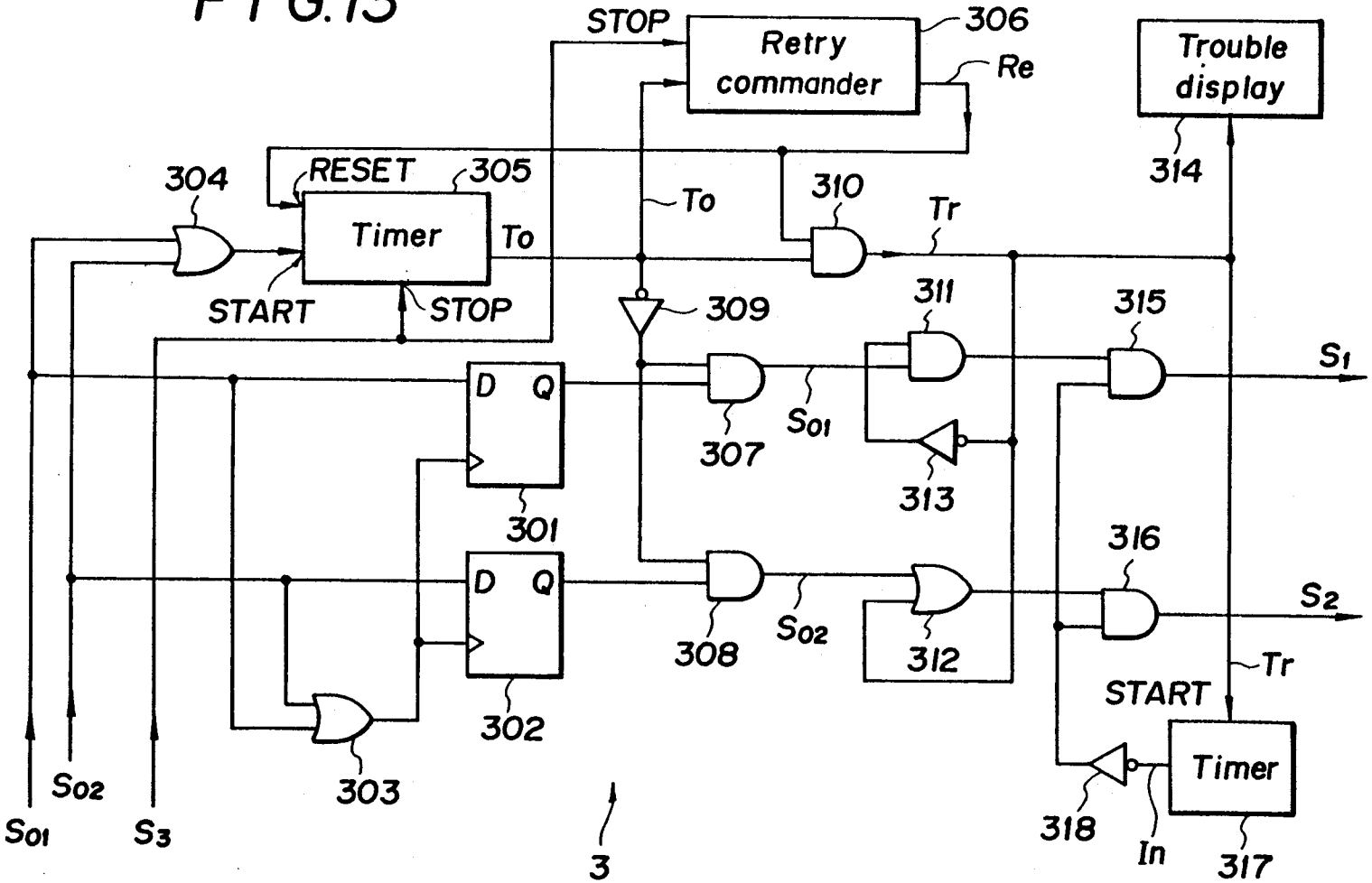
FIG. 13 is a block diagram illustrating a decision circuit in the solenoid valve control circuit shown in each of FIGS. 1 and 7.
Figure 14:
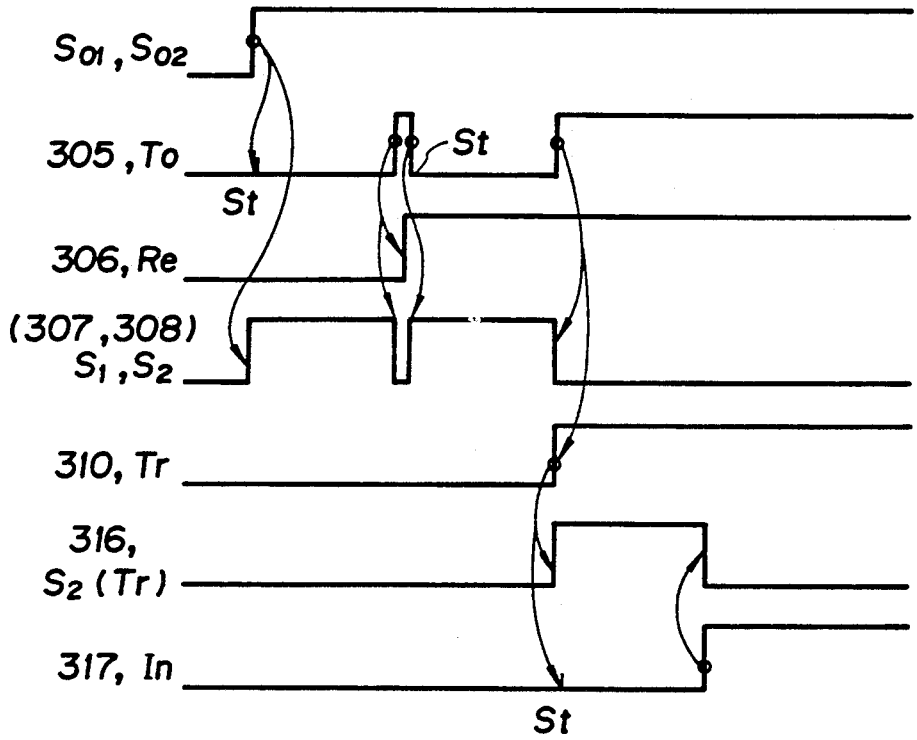
FIG. 14 is a timing chart of output conditions of circuit elements in the circuit shown in FIG. 13.

FIG. 13 shows one detailed circuit arrangement for the decision circuit 3, and FIG. 14 is a timing chart showing output conditions of circuit components in the circuit 3.

The circuit 3 normally generates the valve opening/closing signals S1, S2 based on signals S01, S02 which serve as origins of the signals S1, S2. The signals S01, S02 have waveforms as shown in the charts (d) in FIGS. 3 and 9. When the de-energizing signal S3 is generated, these signals S01, S02 are changed to a "low" level by a non-illustrated logic circuit.

If no de-energizing signal S3 is produced due, for example, to a failure of the coulomb controlling circuit 5 even when the signal S1 or S2 is generated, then the circuit 3 temporarily stops the issuance of the signals S1, S2. Thereafter, the circuit 3 produces the signals S1, S2 again. If a de-energizing signal S3 is still not produced even by the regenerated signals S1, S2, the circuit 3 forcibly closes the valve and stops its controlling operation on the solenoid 2.

More specifically, the origin signals S01, S02 go high in level when the approach/leaving of a user is detected. The origin signals S01, S02 are applied respectively to D input terminals of F/F (flip-flop) circuits 301, 302 which serve as latch circuits. The signals S01, S02 are also applied to an OR gate 303, the output signal of which is applied to a CLK input terminal of the F/Fs 301, 302. Therefore, when either one of the origin signals S01, S02 goes high, both the F/Fs 301, 302 are operated, and a high-level output signal is issued from the Q output terminal of one of the F/Fs to which the high-level signal has been applied. Specifically, when the signal S01 goes high, the high-level output signal is issued only from the Q terminal of the F/F 301. When the signal S02 goes high, the high-level output signal is issued only from the Q terminal of the F/F 302. The output condition of the Q terminals of the F/Fs 301, 302 is latched until the signals S01, S02 go high again after they have gone low. The F/Fs 301, 302 are thus triggered by positive-going edges of the signals applied to their CLK input terminals.

The signals S01, S02 are also applied to an OR gate 304, the output of which is applied to a START terminal of a timer 305. Therefore, the output signal from the OR gate 304 goes high when at least one of the signals S01, S02 goes high, starting the timer 305. The output signal from the timer 305 is normally low in level. When the timer 305 reaches a time-out condition after it has counted the output signal from the OR gate 304 for a prescribed period of time, the timer 305 continuously issues a signal To of a high level. When a retry signal Re of a high level from a retry commander 306 is applied to a RESET terminal of the timer 305 under this condition, the output signal from the timer 305 goes low and starts counting the output signal from the OR gate 304. Times for which the timer 305 counts the input signal in response to signals applied to the START and RESET terminals thereof are equal to each other. These counting times are selected to be longer than the energizing time Tb shown in FIG. 3 at (j).

The output signal from the timer 305 which is normally low is applied to input terminals of AND gates 307, 308 through an inverter 309 to enable the AND gates 307, 308. The other input terminals of the AND gates 307, 308 are supplied with the output signals from the F/Fs 301, 302. The de-energizing signal S3 is applied to the STOP terminals of the timer 305 and the retry commander 306 for stopping the operation of the timer 305 and the retry commander 306. Therefore, insofar as the de-energizing signal S3 is normally generated, the timer 305 does not produce a high-level output signal. Normally, the output signals from the AND gates 307, 308 are thus equal to the origin signals S01, S02, respectively.

The high-level time-out signal To from the timer 305 is applied to the retry commander 306. Simultaneously in response to the time-out signal To, the retry commander 306 applies the high-level retry signal Re to the RESET terminal of the timer 305 and an input terminal of an AND gate 310. The output terminal of the AND gate 310 thus issues a failure signal Tr of a high level only when the timer 305 issues the time-out signal To after the retry signal Re has been issued. The retry commander 306 may comprise a latch circuit.

The output signal from the AND gate 310 is supplied through an inverter 313 to an input terminal of an AND gate 311 and directly to an input terminal of an OR gate 312. The other input terminals of the AND gate 311 and the OR gate 312 are supplied with the signals S01, S02 from the AND gates 307, 308, respectively. Since the output signal from the AND gate 310 is low in level under normal condition, the output signal from the AND gate 311 is equal to the signals S01, S02 under normal condition.

The output signal from the AND gate 310 is sent to a trouble display circuit 314. When the failure signal Tr is issued from the AND gate 310, the trouble display circuit 314 indicates a failure condition through a pilot lamp or the like to show that the control circuit is suffering a failure somewhere therein.

The output signal from the AND gate 310 is also applied to a START terminal of a timer 317. The timer 317 normally continues to issue a low-level output signal. When the high-level failure signal Tr is applied to the START terminal of the timer 317, the timer 317 counts a prescribed period of time, and then continuously issues an output inhibit signal In of a high level. The time interval which is counted by the timer 317 is selected to be longer than the the time counted by the timer 305.

The output signal from the timer 317 is applied via an inverter 318 to input terminals of AND gates 315, 316, the other input terminals of which are supplied with the output signals from the AND gate 311 and the OR gate 312. Normally, the output signal from the timer 317 is low in level, and the output signals from the AND gates 315, 316 are the same as the origin signals S01, S02, respectively, under normal condition. The output signals from the AND gates 315, 316 are supplied as the valve opening/closing signals S1, S2 to the coulomb controlling circuit 5 and the solenoid valve drive circuit 6, respectively.

Operation of the control circuit 3 shown in FIG. 13 will hereinafter be described with reference to FIG. 14. The timing chart of FIG. 14 shows the output conditions of the circuit elements indicated by the corresponding reference characters, and illustrates a failure condition of the control circuit 3 due to trouble of the coulomb controlling circuit 5, for example. As described above, the origin signals S01, S02 are generated by the non-illustrated logic circuit. Indicated at 316, S2(Tr) is a valve closing override signal produced by the failure signal Tr, and indicates that the signal functions in the same manner as the signal S2. Denoted at St in FIG. 14 is a time at which the timers 305, 317 start counting time.

When either the origin signal S01 or S02 goes high in level, the corresponding one of the valve opening/closing signals S1, S2 goes high, starting to energize the solenoid 2. At the same time, the START terminal of the timer 305 is supplied with a high-level signal through the OR gate 304 to start counting a prescribed period of time (>Tb).

Normally, the de-energizing signal S3 is generated before the timer 305 reaches a time-out condition, the origin signals S01, S02 go low, and the timer 305 and the retry commander 306 stop their operation. These conditions are illustrated in FIG. 14.

In the event that no de-energizing signal S3 is produced upon lapse of the energizing time, e.g., Tb, for some reason, the timer 305 reaches a time-out condition. The timer 305 continuously issues a high-level time-out signal To. Therefore, one of the input terminals of each of the AND gates 307, 308 is supplied with a low-level signal from the inverter 309, with the result that the output signals from the AND gates 307, 308 go low again. The conditions of the origin signals S01, S02 are maintained by the Q output signals from the F/Fs 301, 302.

The time-out signal To is sent to the retry commander 306 to enable the latter to issue a retry signal Re after it has closed the discharging switch **5*j* for a prescribed period of time with a delay circuit (not shown). The retry signal Re is applied to the RESET terminal of the timer 305, which then issues a low-level signal and restarts counting a prescribed period of time (Tb<). Since the output signal from the timer 305 goes low, the AND gates 307, 308 are enabled again to issue the condition of the origin signals S01, S02 which are held in the F/Fs 301, 302. While the retry signal Re is also applied to the AND gate 310, the output signal from the timer 305 remains low. The signals from the AND gates 307, 308 are finally issued as the valve opening/closing signals S1, S2 from the AND gates 315, 316**, respectively. This condition is indicated by a second "high" state of the chart represented by (307, 308) S1, S2 in FIG. 14, i.e., a retry condition.

After the signals S1, S2 have been issued again, the origin signals S01, S02 go low if the de-energizing signal S3 is produced before the time-out condition of the timer 305, and the operation of the timer 305 and the retry commander 306 is stopped. This condition is not illustrated in FIG. 14.

If no de-energizing signal S3 is produced upon lapse of the energizing time, e.g., Tb, for some reason, then the timer 305 reaches a time-out condition. The timer 305 continues to issue a high-level time-out signal To. Therefore, the output signals from the AND gates 307, 308 go low, thus inhibiting the transmission of the origin signals S01, S02 past the AND gates 307, 308. As a result, the output of the valve opening/closing signals S1, S2 is inhibited.

Since the retry signal Re is maintained at the high level at this time, the high-level failure signal Tr is issued from the AND gate 310.

The failure signal Tr is sent to the trouble display circuit 314, which then continuously indicates the failure condition.

The failure signal Tr is also applied to the START terminal of the timer 317 to enable the latter to start counting a prescribed period of time. Since the output signal from the timer 317 is low until it reaches a time-out condition, a high-level signal is applied to one input terminal of the AND gate 316 to enable the latter.

The failure signal Tr is also fed to the OR gate 312. Therefore, the output signal from the OR gate 312 goes high, and is issued as the valve closing signal S2 (Tr) caused by the failure signal Tr. The solenoid valve drive circuit 6 closes the valve in response to the signal S2 (Tr).

When the timer 317 has completed the counting of the prescribed time, it issues a high-level output inhibit signal In to disable the AND gates 315, 316, so that the issuance of the valve closing signal S2 (Tr) is inhibited. The timer 317 subsequently continues to issue the output inhibit signal In to inhibit the issuance of the valve opening/closing signals S1, S2.

Even after the forced closing of the valve with the override signal S2 (Tr) has been brought to an end, the failure signal Tr and the output inhibit signal In are maintained to inhibit the solenoid 2 from being energized and to indicate the failure.

With the aforesaid arrangement of the decision circuit 3, any wasteful consumption of the electric energy stored in the battery, which would otherwise be caused by some failure of the control circuit, can be avoided. Even if no de-energizing signal S3 is obtained within a prescribed period of time, the valve opening/closing signals S1, S2 are automatically rendered low, thus effectively preventing a reverse latching phenomenon in which if the energizing time is long, the valve which has once been opened is closed again because of solenoid characteristics exhibited when closing the solenoid.

Since the circuit 3 informs the operator of a failure condition, the operator can immediately find such a failure of the control circuit. In addition, the valve is forcibly closed when the circuit 3 determines that the control circuit suffers a failure. Accordingly, the control circuit is associated with an effective fail-safe system.

The circuit 3 does not regard a single time-out condition of the timer 305 as a failure, but tries to energize the solenoid again through the retry commander 306 should such a time-out condition occur. This prevents the control circuit from being de-energized by a single extrinsic error which may be caused by noise or the like.

Figure 15:
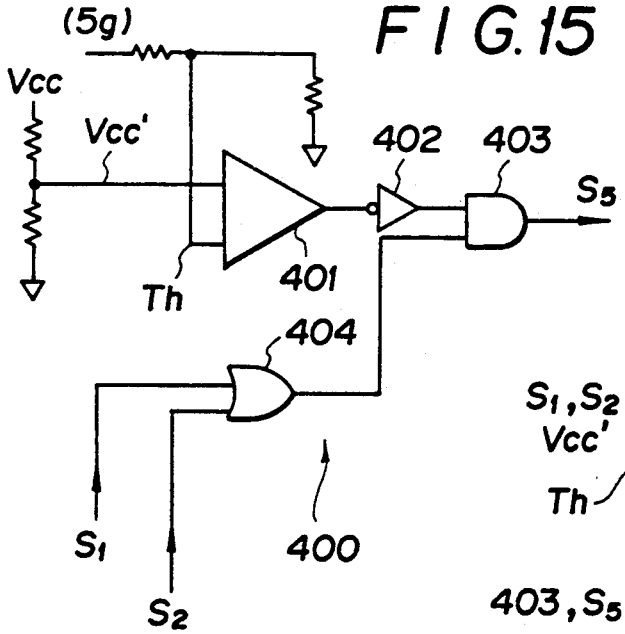
FIG. 15 is a block diagram of a portion of a solenoid valve control circuit according to a third modification.

A solenoid valve control circuit 400 according to a third modification will be described with reference to FIGS. 15 and 16. Circuit elements 401, 402, 403, 404 illustrated in FIG. 15 are added to the control circuit 10 or 100, described above for detecting a drop in the battery voltage Vcc.

A voltage produced by dividing the output voltage from the reference voltage generator 5g by a prescribed ratio is applied as a reference voltage Th to a comparator 401, the reference voltage Th having a threshold value. The battery voltage Vcc is divided into an input voltage Vcc' which is applied to the comparator 401. When the input voltage Vcc' is higher than the threshold voltage Th, the comparator 401 issues a high-level signal to one input terminal of an AND gate 403 through an inverter 402.

The valve opening/closing signals S1, S2 are applied to an OR gate 404, the output signal of which is applied to the other input terminal of the AND gate 403. Thus, while either the signal S1 or S2 is high in level, the AND gate 403 is enabled to issue an output signal. That is, the AND gate 403 can issue an output signal only when the solenoid 2 is energized.

If the voltage Vcc' drops lower than the threshold voltage Th while either the signal S1 or S2 is high and the solenoid 2 is being energized, the output signal from the comparator 401 goes low. The low-level signal from the comparator 401 is applied through an inverter 402 as a high-level signal to the AND gate 403. Consequently, the AND gate 403 issues a signal S5 of a high level which represents that the battery voltage Vcc drops lower than a prescribed voltage level.

Figure 16:
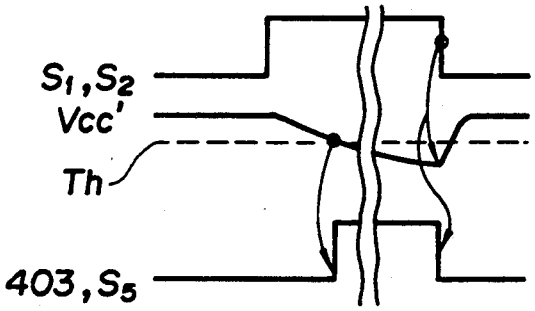
FIG. 16 is a timing chart of output conditions of circuit elements in the circuit shown in FIG. 15.

FIG. 16 shows the output condition of the voltage drop signal S5. The voltage drop signal S5 is delivered to a non-illustrated circuit so as to be processed thereby in a predetermined manner.

For example, the signal S5 may be sent to a latch circuit (not shown) which produces an output signal to enable a liquid crystal display, to display the reduction in the battery voltage.

The signal S5 may be employed to perform the same function as the failure signal Tr shown in FIGS. 13 and 14.

A drop in the battery voltage Vcc when there is no load on the battery can be detected even by dispensing with the OR gate 404 and the AND gate 403. It is practically preferable, however, to detect any drop in the voltage Vcc when the battery is loaded by energizing the solenoid 2 as illustrated. While only one threshold Th is employed in the above modification, two threshold values may be established, with the higher threshold value used for warning the operator about a voltage drop and the lower threshold value for de-energizing the entire control system.

FIG. 17 illustrates a solenoid valve control circuit 500 according to a fourth modification of the present invention. Circuit components 501, 502, 503 shown in FIG. 17 are added to the control circuit 10 or 100 for determining that the battery is used up when the solenoid 2 is energized a number of times in excess of a predetermined number.

The solenoid opening/closing signals S1, S2 are applied to an OR gate 501, the output signal of which is applied to a counter 502 to count the number of times which the solenoid 2 is energized. The count is then applied as a digital signal to a digital comparator 503.

A reference count applied to the digital comparator 503 is set to a prescribed value (=an integer) through a jumper switch J. The reference count is selected to be a number of times the solenoid 2 is energized to use up the electric energy stored in the battery. The digital comparator 503 issues an output signal S6 of a high level when the count exceeds the reference count.

The signal S6 is a signal which statistically or indirectly represents that the battery voltage Vcc drops below a prescribed value. The voltage drop signal S6 is sent to a certain circuit (not shown) so as to be processed thereby. The signal S6 is practically equivalent to the voltage drop signal S5 described above, and the manner of utilizing the signal S6 is also the same as the manner of utilizing the signal S5.

A solenoid valve control circuit 600 in accordance with a fifth modification of the present invention is shown in FIG. 18. Circuit elements 401, 402, 403, 404 (or 501), 502, 503 shown in FIG. 18 are added to the control circuit 10 or 100. Those circuit elements in FIG. 18 which are identical to those of the control circuits 400 and 500 will not be described below.

The control circuit 600 simultaneously performs the functions of the control circuits 400, 500. However, the signals S5, S6 are applied to an OR gate 601, which produces an output signal S7 of a high level when the signal S5 or S6 goes high. The signal S7 is applied a certain circuit and processed thereby.

The signal S7 is produced when the solenoid 2 has been energized a number of times in excess of a predetermined number or when the battery voltage Vcc drops below a prescribed value. By using the signal S7 as a battery consumption signal, the battery can reliably be replaced with a new one before the battery power is completely used up.

FIG. 1 shows a solenoid valve control circuit 700 according to a sixth modification of the present invention.

The control circuit 700 includes a solenoid valve drive circuit 6 in the form of a bridge circuit, and a capacitor 701 connected parallel to the drive circuit 6. The capacitor 701 has a relatively large capacitance C1 for supplying the solenoid 2 with an electric current which is large enough to open the valve.

Under normal conditions, the valve opening/closing signals S1, S2 are low in level, rendering the drive circuit 6 nonconductive. At this time, the capacitor 701 is charged to a voltage equal to the battery voltage Vcc at the time there is no load on the battery. Therefore, the capacitor 701 is charged to C1·Vcc.

When the approach of a user is detected and the valve opening signal S1 goes high, for example, the drive circuit 6 is rendered conductive. Under this condition, a current flows mainly from the capacitor 701 into the drive circuit 6. Upon lapse of a prescribed period of time in which the electric quantity Q supplied to the solenoid 2 should reach a predetermined value, the signal S1 goes low, making the drive circuit 6 nonconductive. Thereafter, the capacitor 701 is gradually charged in readiness for a next cycle of energization of the solenoid 2.

While the signal S1 is high in level and the solenoid 2 is being energized, the battery voltage Vcc does not drops significantly.

While the above valve is opened in the above description, the solenoid 2 is also energized mainly by the capacitor 701 for closing the valve.

In the control circuit 700, the solenoid 2 is energized mainly by the capacitor 701. Therefore, even if the battery voltage Vcc when the battery is loaded is considerably lowered at the end of the service life of the battery, the solenoid 2 is supplied with the same electric quantity as that which is available at the beginning of the battery service life. As a result, the electric energy stored in the battery can fully be utilized without being wasted.

The aforesaid modifications of the invention may be combined in various combinations.

Although there have been described what are at present considered to be the preferred embodiments of the present invention, it will be understood that the invention may be embodied in other specific forms without departing from the essential characteristics thereof. The present embodiments are therefore to be considered in all aspects as illustrative, and not restrictive. The scope of the invention is indicated by the appended claims rather than by the foregoing description.

We claim:

1. A solenoid valve control circuit for operatively connecting a battery to a solenoid to energize the solenoid to actuate a valve, said control circuit including coulomb controlling means for controllably supplying an electric quantity to the solenoid, wherein said electric quantity if a required electric quantity corresponding to the voltage of said battery, said coulomb controlling means comprising means for supplying said required electric quantity to said solenoid, a decision circuit for producing an energizing signal indicating that said battery is to be connected to said solenoid under a prescribed condition; and a solenoid valve drive circuit responsive to said energizing signal for operatively connecting said battery to said solenoid to energize said solenoid, and wherein said coulomb controlling means comprises:

a power supply voltage monitoring circuit for monitoring the voltage of said battery and producing a signal corresponding to the battery voltage; and a coulomb controlling circuit for monitoring the electric quantity supplied from said battery to said solenoid and for producing a de-energizing signal based on the signal from said power supply voltage monitoring circuit when the electric quantity supplied to said solenoid is equal to said required electric quantity corresponding to said battery voltage.

2. A solenoid valve control circuit according to claim 1, wherein said coulomb controlling circuit comprises:

an amplifying circuit connected to said solenoid for amplifying an electric current to be supplied to the solenoid;

a capacitor chargeable to a prescribed charge level in response to the amplified current from said amplifying circuit; and a comparator for comparing a voltage across said capacitor with a reference voltage and producing said de-energizing signal when the voltage across said capacitor is equal to said reference voltage; and said amplifying circuit being responsive to said signal corresponding to the battery voltage from said power supply voltage monitoring circuit for amplifying said electric current to be supplied to said solenoid at a gain proportional to said battery voltage.

3. A solenoid valve control circuit according to claim 2, wherein said amplifying circuit amplifies said electric current at a constant gain when said battery voltage is relatively high, said reference voltage of said comparator being set to be equal to the voltage across said capacitor when said required quantity of electric charge is supplied to said solenoid in case said battery voltage is relatively high.

4. A solenoid valve control circuit according to claim 1, wherein said de-energizing signal from said coulomb controlling circuit is supplied to said decision circuit, said decision circuit being responsive to said de-energizing signal for stopping the generation of said energizing signal.

5. A solenoid valve control circuit according to claim 1, wherein said decision circuit comprises a timer circuit for producing a time-out signal to stop the generation of said energizing signal when said de-energizing signal is not produced upon lapse of a predetermined period of time after said energizing signal has been produced.

6. A solenoid valve control circuit according to claim 5, wherein said decision circuit further comprises a retry commander for producing a retry signal to generate said energizing signal once more when said time-out signal is produced by said timer circuit.

7. A solenoid valve control circuit according to claim 6, wherein said decision circuit further comprises a failure determining circuit for producing a failure signal to stop controlling said solenoid when said de-energizing signal is not produced upon lapse of a predetermined period of time after said energizing signal has been produced again based on said retry signal.

8. A solenoid valve control circuit according to claim 7, wherein said failure determining circuit comprises a valve closing override circuit for forcibly closing said valve, and a trouble display circuit for indicating a failure condition.

9. A solenoid valve control circuit according to claim 1, wherein said decision circuit further comprises a failure determining circuit for producing a failure signal to stop controlling said solenoid when said de-energizing signal is not produced upon lapse of a predetermined period of time after said energizing signal has been produced.

10. A solenoid valve control circuit according to claim 1, further comprising:

a voltage drop detecting circuit for detecting a drop in the voltage of said battery below a predetermined value and for producing a voltage drop signal indicative of the detected voltage drop.

11. A solenoid valve control circuit according to claim 1, further comprising a counting circuit for detecting that the number of times said solenoid is energized by said battery exceeds a predetermined number and for producing a voltage drop signal indicative of the detected number of times.

12. A solenoid valve control circuit according to claim 1, further comprising:

a voltage drop detecting circuit for detecting a drop in the voltage of said battery below a predetermined value and for producing a first voltage drop signal indicative of the detected voltage drop; and a counting circuit for detecting that the number of times said solenoid is energized by said battery exceeds a predetermined number and for producing a second voltage drop signal indicative of the detected number of times.

13. A solenoid valve control circuit according to claim 1, further comprising:

a capacitor chargeable to a charge level by said battery while said solenoid is not being energized by said battery, said solenoid being supplied with an electric current from said capacitor when said solenoid is energized.

14. In a solenoid valve control circuit including a latching solenoid for driving a plunger of a latching-type solenoid valve from a closed position to an open position and from said open position to said closed position when said solenoid is operatively connected to a battery, the improvement comprising:

coulomb controlling means for controlling a total quantity of electric charge to equal a predetermined value, said total quantity of electric charge being a required quantity of electric charge corresponding to the voltage of said battery and supplied from said battery to said latching solenoid when said plunger is to be driven from said closed position to said open position and from said open position to said closed position, wherein said coulomb controlling means supplies said required quantity of electric charge to said latching solenoid;

a decision circuit for producing an energizing signal indicating that said battery is to be connected to said latching solenoid under a prescribed condition; and a solenoid valve drive circuit responsive to said energizing signal for operatively connecting said battery to said latching solenoid to energize said solenoid, and wherein said coulomb controlling means comprises:

a power supply voltage monitoring circuit for monitoring the voltage of said battery and producing a signal corresponding to the battery voltage; and a coulomb controlling circuit for monitoring the total quantity of electric charge supplied from said battery to said latching solenoid and for producing a de-energizing signal based on the signal from said power supply voltage monitoring circuit when the total quantity of electric charge supplied to said latching solenoid is equal to said required quantity of electric charge corresponding to said battery voltage.

15. A solenoid valve control circuit according to claim 14, wherein said coulomb controlling circuit comprises:

an amplifying circuit connected to said latching solenoid for amplifying an electric current to be supplied to the latching solenoid;

a capacitor chargeable to a prescribed charge level in response to the amplified current from said amplifying circuit; and a comparator for comparing a voltage across said capacitor with a reference voltage and producing said de-energizing signal when the voltage across said capacitor is equal to said reference voltage; and said amplifying circuit being responsive to said signal corresponding to the battery voltage from said power supply voltage monitoring circuit for amplifying said electric current to be supplied to said latching solenoid at a gain proportional to said battery voltage.

16. A solenoid valve control circuit according to claim 15, wherein said amplifying circuit amplifies said electric current at a constant gain when said battery voltage is relatively high, said reference voltage of said comparator being set to be equal to the voltage across said capacitor when said required quantity of electric charge is supplied to said latching solenoid in case said battery voltage is relatively high.

17. A solenoid valve control circuit according to claim 14, wherein said de-energizing signal from said coulomb controlling circuit is supplied to said decision circuit, said decision circuit being responsive to said de-energizing signal for stopping the generation of said energizing signal.

18. A solenoid valve control circuit according to claim 3, wherein said decision circuit comprises a timer circuit for producing a time-out signal to stop the generation of said energizing signal when said de-energizing signal is not produced upon lapse of a predetermined period of time after said energizing signal has been produced.

19. A solenoid valve control circuit according to claim 18, wherein said decision circuit further comprises a retry commander for producing a retry signal to generate said energizing signal once more when said time-out signal is produced by said timer circuit.

20. A solenoid valve control circuit according to claim 19, wherein said decision circuit further comprises a failure determining circuit for producing a failure signal to stop controlling said latching solenoid when said de-energizing signal is not produced upon lapse of a predetermined period of time after said energizing signal has been produced again based on said retry signal.

21. A solenoid valve control circuit according to claim 20, wherein said failure determining circuit comprises a valve closing override circuit for forcibly closing said valve, and a trouble display circuit for indicating a failure condition.

22. A solenoid valve control circuit according to claim 14, wherein said decision circuit further comprises a failure determining circuit for producing a failure signal to stop controlling said latching solenoid when said de-energizing signal is not produced upon lapse of a predetermined period of time after said energizing signal has been produced.

23. A solenoid valve control circuit according to claim 14, further comprising:

a voltage drop detecting circuit for detecting a drop in the voltage of said battery below a predetermined value and for producing a voltage drop signal indicative of the detected voltage drop.

24. A solenoid valve control circuit according to claim 14, further comprising a counting circuit for detecting that the number of times said latching solenoid is energized by said battery exceeds a predetermined number and for producing a voltage drop signal indicative of the detected number of times.

25. A solenoid valve control circuit according to claim 14, further comprising:

a voltage drop detecting circuit for detecting a drop in the voltage of said battery below a predetermined value and for producing a first voltage drop signal indicative of the detected voltage drop; and a counting circuit for detecting that the number of times said latching solenoid is energized by said battery exceeds a predetermined number and for producing a second voltage drop signal indicative of the detected number of times.

26. A solenoid valve control circuit according to claim 14, further comprising:

a capacitor chargeable to a charge level by said battery while said latching solenoid is not being energized by said battery, said latching solenoid being supplied with an electric current from said capacitor when said latching solenoid is energized.

27. In a solenoid valve control circuit for latching-type solenoid valve including a plunger serving as a valve body movable between an open position and a closed position, first latching means for latching said plunger in said closed position, second latching means for latching said plunger in said open position, and a latching solenoid for driving the plunger from said closed position to said open position and from said open position to said closed position when said latching solenoid is operatively connected to a battery by said control circuit, the improvement comprising:

coulomb controlling means for controlling a total quantity of electric charge at a predetermined value, said total quantity of electric charge being supplied from said battery to said latching solenoid when said plunger is to be driven from said closed position to said open position and from said open position to said closed position;

a decision circuit for producing an energizing signal indicating that said battery is to be connected to said latching solenoid under a prescribed condition; and wherein said coulomb controlling means comprises:

a power supply voltage monitoring circuit for monitoring the voltage of said battery and producing a signal corresponding to the battery voltage;

an energizing time decision circuit for determining an energizing time in which said latching solenoid is to be energized, in response to said energizing signal from said decision circuit and said signal corresponding to said battery voltage from said power supply voltage monitoring circuit; and a drive circuit for connecting said battery to said latching solenoid to energize said latching solenoid for said determined energizing time.

28. In a solenoid valve control circuit for latching-type solenoid valve including a plunger serving as a valve body movable between an open position and a closed position, first latching means for latching said plunger in said closed position, second latching means for latching said plunger in said open position, and a latching solenoid for driving the plunger from said closed position to said open position and from said open position to said closed position when said latching solenoid is operatively connected to a battery by said control circuit, the improvement comprising:

coulomb controlling means for controlling a total quantity of electric charge at a predetermined value, said total quantity of electric charge being supplied from said battery to said latching solenoid when said plunger is to be driven from said closed position to said open position and from said open position to said closed position;

a decision circuit for producing an energizing signal indicating that said battery is to be connected to said latching solenoid under a prescribed condition, and wherein said coulomb controlling means comprises:

an energizing time decision circuit for determining an energizing time in which said latching solenoid is to be energized, in response to said energizing signal from said decision circuit; and a drive circuit for connecting said battery to said latching solenoid to energize said latching solenoid for said determined energizing time.

29. In a solenoid valve control circuit (10;20;100;200;400;500;600;700) for latching-type solenoid valve including a plunger serving as a valve body movable between an open position and a closed position, first latching means for latching said plunger in said closed position, second latching means for latching said plunger in said open position, and a latching solenoid (2) for driving the plunger from said closed position to said open position and from said open position to said closed position when said latching solenoid is operatively connected to a battery (1) by said control circuit, the improvement comprising:

coulomb controlling means (4,5;5) for controlling a total quantity of electric charge (Q) at a predetermined value (Qo,Qc;Q10), said total quantity of electric charge (Q) being a quantity of electric charge having a constant value supplied from said battery (1) to said latching solenoid (2) when said plunger is to be driven from said closed position to said open position and from said open position to said closed position, wherein said coulomb controlling means supplies said constant-value quantity of electric charge to said solenoid;

a decision circuit for producing an energizing signal indicating that said battery is to be connected to said latching solenoid under a prescribed condition; and a solenoid valve drive circuit responsive to said energizing signal for operatively connecting said battery to said latching solenoid to energize said latching solenoid, and wherein said coulomb controlling means comprises:

a coulomb controlling circuit for monitoring the total quantity of electric charge supplied from said battery to said latching solenoid and for producing a de-energizing signal when the total quantity of electric charge supplied to said solenoid is equal to said constant-value quantity of electric charge.

30. A solenoid valve control circuit according to claim 29, wherein said coulomb controlling circuit comprises:

an amplifying circuit connected to said latching solenoid for amplifying an electric current to be supplied to the latching solenoid at a prescribed gain;

a capacitor chargeable to a prescribed charge level in response to the amplified current from said amplifying circuit; and a comparator for comparing a voltage across said capacitor with a reference voltage and producing said de-energizing signal when the voltage across said capacitor is equal to said reference voltage.

31. A solenoid valve control circuit according to claim 30, wherein said constant-value quantity of electric charge is a quantity of electric charge required by said latching solenoid when the voltage of said battery is of a stable value, and said reference voltage of said comparator is equal to the voltage across said capacitor when said required quantity of electric charge is supplied to said latching solenoid.

32. A solenoid valve control circuit according to claim 29, wherein said de-energizing signal from said coulomb controlling circuit is supplied to said decision circuit, said decision circuit being responsive to said de-energizing signal for stopping the generation of said energizing signal.

33. A solenoid valve control circuit according to claim 29, wherein said decision circuit comprises a timer circuit for producing a time-out signal to stop the generation of said energizing signal when said de-energizing signal is not produced upon lapse of a predetermined period of time after said energizing signal has been produced.

34. A solenoid valve control circuit according to claim 33, wherein said decision circuit further comprises a retry commander for producing a retry signal to generate said energizing signal once more when said time-out signal is produced by said timer circuit.

35. A solenoid valve control circuit according to claim 34, wherein said decision circuit further comprises a failure determining circuit for producing a failure signal to stop controlling said latching solenoid when said de-energizing signal is not produced upon lapse of a predetermined period of time after said energizing signal has been produced again based on said retry signal.

36. A solenoid valve control circuit according to claim 25, wherein said failure determining circuit comprises a valve closing override circuit for forcibly closing said valve, and a trouble display circuit for indicating a failure condition.

37. A solenoid valve control circuit according to claim 28, wherein said decision circuit further comprises a failure determining circuit for producing a failure signal to stop controlling said latching solenoid when said de-energizing signal is not produced upon lapse of a predetermined period of time after said energizing signal has been produced.

38. In a solenoid valve control circuit for operatively connecting a battery to a solenoid to energize the solenoid to actuate a valve having a valve body movable between an open position and a closed position, said solenoid driving a plunger when said solenoid is operatively connected to the battery by said control circuit, the improvement comprising:

coulomb controlling means for controlling a total quantity of electric charge to a predetermined value, said total quantity of electric charge being a quantity of electric charge having a constant value supplied from said battery to said solenoid when said valve body is to be moved from said closed position to said open position and from said open position to said closed position, wherein said coulomb controlling means supplies said constant-value quantity of electric charge to said solenoid;

a decision circuit for producing an energizing signal indicating that said battery is to be connected to said solenoid under a prescribed condition, and a solenoid valve drive circuit responsive to said energizing signal for operatively connecting said battery to said solenoid to energize said solenoid, and wherein said coulomb controlling means comprises:

a coulomb controlling circuit for monitoring the total quantity of electric charge supplied from said battery to said solenoid and for producing a de-energizing signal when the total quantity of electric charge supplied to said solenoid is equal to said constant-value quantity of electric charge.

39. A solenoid valve control circuit according to claim 38, wherein said coulomb controlling circuit comprises:

an amplifying circuit connected to said solenoid for amplifying an electric current to be supplied to the solenoid at a prescribed gain;

a capacitor chargeable to a prescribed charge level in response to the amplified current from said amplifying circuit; and a comparator for comparing a voltage across said capacitor with a reference voltage and producing said de-energizing signal when the voltage across said capacitor is equal to said reference voltage.

40. A solenoid valve control circuit according to claim 39, wherein said constant-value quantity of electric charge is a quantity of electric charge required by said solenoid when the voltage of said battery is of a stable value, and said reference voltage of said comparator is equal to the voltage across said capacitor when said required quantity of electric charge is supplied to said solenoid.

41. A solenoid valve control circuit according to claim 38, wherein de-energizing signal from said coulomb controlling circuit is supplied to said decision circuit, said decision circuit being responsive to said de-energizing signal for stopping the generation of said energizing signal.

42. A solenoid valve control circuit according to claim 38, wherein said decision circuit comprises a timer circuit for producing a time-out signal to stop the generation of said energizing signal when said de-energizing signal is not produced upon lapse of a predetermined period of time after said energizing signal has been produced.

43. A solenoid valve control circuit according to claim 42, wherein said decision circuit further comprises a retry commander for producing a retry signal to generate said energizing signal once more when said time-out signal is produced by said timer circuit.

44. A solenoid valve control circuit according to claim 43, wherein said decision circuit further comprises a failure determining circuit for producing a failure signal to stop controlling said solenoid when said de-energizing signal is not produced upon lapse of a predetermined period of time after said energizing signal has been produced again based on said retry signal.

45. A solenoid valve control circuit according to claim 44, wherein said failure determining circuit comprises a valve closing override circuit for forcibly closing said valve, and a trouble display circuit for indicating a failure condition.

46. A solenoid valve control circuit according to claim 38, wherein said decision circuit further comprises a failure determining circuit for producing a failure signal to stop controlling said solenoid when said de-energizing signal is not produced upon lapse of a predetermined period of time after said energizing signal has been produced.

47. In a solenoid valve control circuit for operatively connecting a battery to a solenoid to energize the solenoid to actuate a valve having a valve body movable between an open position and a closed position, said solenoid driving a plunger when said solenoid is operatively connected to the battery by said control circuit, the improvement comprising:

coulomb controlling means for controlling a total quantity of electric charge at a predetermined value, said total quantity of electric charge being supplied from said battery to said solenoid when said valve body is to be moved from said closed position to said open position and from said open position to said closed position;

a decision circuit for producing an energizing signal indicating that said battery is to be connected to said solenoid under a prescribed condition, and wherein said coulomb controlling means comprises:

a power supply voltage monitoring circuit for monitoring the voltage of said battery and producing a signal corresponding to the battery voltage;

an energizing time decision circuit for determining an energizing time in which said solenoid is to be energized, in response to said energizing signal from said decision circuit and said signal corresponding to said battery voltage from said power supply voltage monitoring circuit; and a drive circuit for connecting said battery to said solenoid to energize said solenoid for said determined energizing time.

48. In a solenoid valve control circuit for operatively connecting a battery to a solenoid to energize the solenoid to actuate a valve having a valve body movable between an open position and a closed position, said solenoid driving a plunger when said solenoid is operatively connected to the battery by said control circuit, the improvement comprising:

coulomb controlling means for controlling a total quantity of electric charge at a predetermined value, said total quantity of electric charge being supplied from said battery to said solenoid when said valve body is to be moved from said closed position to said open position and from said open position to said closed position;

a decision circuit for producing an energizing signal indicating that said battery is to be connected to said solenoid under a prescribed condition, and wherein said coulomb controlling means comprises:

an energizing time decision circuit for determining an energizing time in which said solenoid is to be energized, in response to said energizing signal from said decision circuit; and a drive circuit for connecting said battery to said solenoid to energize said solenoid for said determined energizing time.

* * * * *

UNITED STATES PATENT AND TRADEMARK OFFICE

CERTIFICATE OF CORRECTION

PATENT NO. : 5,008,773

DATED : APRIL 16, 1991

INVENTOR(S) : Takao YOSHIDA et al.

It is certified that error appears in the above-identified patent and that said Letters Patent is hereby corrected as shown below:

On the title page, under [75] Inventors, please replace the third inventor's name, which has been misspelled as "TAKHIRO DOUKE", by --TAKAHIRO DOUKE--.

Signed and Sealed this

Eleventh Day of August, 1992

*Attest:*

DOUGLAS B. COMER

*Attesting Officer*

*Acting Commissioner of Patents and Trademarks*